US009932954B2

(12) United States Patent
Nakamura et al.

(10) Patent No.: US 9,932,954 B2
(45) Date of Patent: Apr. 3, 2018

(54) IGNITION DEVICE FOR INTERNAL COMBUSTION ENGINES

(71) Applicant: DENSO CORPORATION, Kariya, Aichi-pref. (JP)

(72) Inventors: Naohisa Nakamura, Kariya (JP); Hisaharu Morita, Kariya (JP); Kouji Andoh, Kariya (JP); Shunichi Takeda, Kariya (JP)

(73) Assignee: DENSO CORPORATION, Kariya (JP)

( * ) Notice: Subject to any disclaimer, the term of this patent is extended or adjusted under 35 U.S.C. 154(b) by 6 days.

(21) Appl. No.: 15/302,536

(22) PCT Filed: Apr. 3, 2015

(86) PCT No.: PCT/JP2015/060544
§ 371 (c)(1),
(2) Date: Oct. 7, 2016

(87) PCT Pub. No.: WO2015/156216
PCT Pub. Date: Oct. 15, 2015

(65) Prior Publication Data

US 2017/0030318 A1 Feb. 2, 2017

(30) Foreign Application Priority Data

Apr. 10, 2014 (JP) ..... 2014-080765
Apr. 10, 2014 (JP) ..... 2014-080767
Jan. 27, 2015 (JP) ..... 2015-013289

(51) Int. Cl.
*F02P 15/10* (2006.01)
*F02P 3/04* (2006.01)
(Continued)

(52) U.S. Cl.
CPC ..... *F02P 3/04* (2013.01); *F02P 3/0892* (2013.01); *F02P 5/00* (2013.01); *F02P 9/002* (2013.01);
(Continued)

(58) Field of Classification Search
CPC .... F02P 3/04; F02P 3/0892; F02P 5/00; F02P 9/002; F02P 9/007; F02P 15/10; F02P 5/1502; F02P 15/08
(Continued)

(56) References Cited

U.S. PATENT DOCUMENTS 5,571,245 A 11/1996 Ooyabu et al.
5,754,011 A * 5/1998 Frus ..... F02P 3/0869 315/209 SC
(Continued)

FOREIGN PATENT DOCUMENTS

JP 2000-199470 7/2000
JP 2007-120374 5/2007
(Continued)

*Primary Examiner* — Thomas Moulis
(74) *Attorney, Agent, or Firm* — Nixon & Vanderhye PC

(57) ABSTRACT

An ignition device for engine according to the present invention performs continuous spark discharge of an ignition plug by using a multiplex signal, an integration signal or a control signal. In the multiplex signal, discharge continuous signals IGW#1 to 4 for cylinders of the engine have been multiplexed. In the integration signal, a discharge continuous signal IGW and a secondary current instruction signal IGA have been added to an ignition signal IGT. In the control signal, the secondary current instruction signal IGA has been added into the multiplex signal or the integration signal. This structure can reduce the total number of signal lines connected between an ECU and a controller, and further reduce a signal line to transmit the secondary current instruction signal IGA.

12 Claims, 26 Drawing Sheets

(51) Int. Cl.
*F02P 9/00* (2006.01)
*F02P 3/08* (2006.01)
*F02P 5/00* (2006.01)
*F02P 5/15* (2006.01)

(52) U.S. Cl.
CPC ..... *F02P 9/007* (2013.01); *F02P 15/10* (2013.01); *F02P 5/1502* (2013.01)

(58) Field of Classification Search
USPC ..... 123/636–639
See application file for complete search history.

(56) References Cited

U.S. PATENT DOCUMENTS 6,115,665 A * 9/2000 Rosner ..... F02P 3/0442 123/406.51
7,552,724 B2 * 6/2009 Yamauchi ..... F02P 3/0892 123/604
8,931,457 B2 * 1/2015 Petruska ..... F02P 15/02 123/406.12
9,605,644 B2 * 3/2017 Huberts ..... F02P 9/002
2003/0164164 A1 * 9/2003 Butler, Jr. ..... G01L 23/225 123/606
2003/0168049 A1 * 9/2003 Zarkhin ..... F02P 3/0453 123/609
2004/0007222 A1 * 1/2004 Skinner ..... F02P 3/02 123/609
2004/0084034 A1 * 5/2004 Huberts ..... F02P 3/045 123/630
2004/0084035 A1 * 5/2004 Newton ..... F02P 3/045 123/630
2004/0084036 A1 * 5/2004 Porter ..... F02D 35/027 123/634
2006/0021607 A1 2/2006 Toriyama
2007/0062501 A1 * 3/2007 Ishida ..... F02P 3/0838 123/618
2007/0175461 A1 8/2007 Wada et al.
2007/0215100 A1 * 9/2007 Maeda ..... F02P 15/08 123/310
2007/0267004 A1 11/2007 Yamauchi
2008/0127937 A1 6/2008 Toriyama et al.
2009/0108846 A1 4/2009 Koda et al.
2009/0183719 A1 * 7/2009 Aida ..... F02P 17/12 123/644
2011/0041804 A1 * 2/2011 Petruska ..... F02P 3/01 123/406.12
2013/0263834 A1 * 10/2013 Tanaya ..... F02P 3/053 123/623
2017/0022960 A1 * 1/2017 Takeda ..... F02P 3/05
2017/0022961 A1 * 1/2017 Toriyama ..... F02P 3/08
2017/0030320 A1 * 2/2017 Terada ..... F02P 3/08
2017/0159634 A1 * 6/2017 Fujimoto ..... F02P 11/06

FOREIGN PATENT DOCUMENTS

JP 2009-052435 3/2009
JP 2015-200300 11/2015
JP 2015-206355 11/2015

* cited by examiner

IGNITION DEVICE FOR INTERNAL COMBUSTION ENGINES

This application is the U.S. national phase of International Application No. PCT/JP2015/060544 filed 3 Apr. 2015, which designated the U.S. and claims priority to JP Patent Application Nos. 2014-080765 filed 10 Apr. 2014, 2014-080767 filed 10 Apr. 2014, and 2015-013289 filed 27 Jan. 2015, the entire contents of each of which are hereby incorporated by reference.

TECHNICAL FIELD

The present invention relates to ignition devices to be used for internal combustion engines, and in particular relates to ignition devices capable of continuous spark discharge.

BACKGROUND ART

In order to reducing a load of a spark plug, suppressing wasteful electric power consumption, and maintaining continuous spark discharge from the spark plug, an energy input circuit has been developed that is capable of maintaining the continuous spark discharge from the spark plug during, an optional period (hereinafter, continuous discharge period). The continuous spark discharge is generated by using a unidirectional current (secondary DC current) to a secondary coil by supplying electric energy to a battery voltage supply line from a low-voltage side of a primary coil before the main ignition of the spark plug is interrupted after first spark discharge (main ignition) is started by a known ignition circuit. (This technique is not a conventional technique, but a new technique.) A spark discharge (following the main ignition) continued by the energy input circuit will be referred to as the continuous spark discharge.

The energy input circuit maintains the spark discharge from the spark plug by adjusting the secondary current. The secondary current is adjusted by controlling a primary current (input energy) during the continuous discharge period. Adjusting the secondary current during the continuous discharge period can reduce a load of the spark plug caused by the repetition of the burn-out of the spark discharge and regeneration of the spark discharge. This further suppresses unnecessary electric power consumption, and provides continuous spark discharge from the spark plug. Further, because the secondary current flows in the same direction during the continuous spark discharge after the main ignition of the spark plug, it is possible to continue the spark discharge after the main ignition without the spark discharge being interrupted. For this reason, it is possible for the continuous spark discharge from the spark plug to avoid the burn-out of the spark discharge even if a swing flow of fuel and air is generated in a cylinder in a lean combustion.

Next, a description will be given of a typical example (to which the present invention is not applied) of an ignition device performing continuous spark discharge from the spark plug in order to recognize the concept of the present invention with reference to FIG. 24 to FIG. 26. (As previously described, the ignition device according to the present invention is a new technique different from a conventional technique.) The same components between the conventional technique shown in FIG. 24 to FIG. 26 and the following exemplary embodiments of the present invention will be referred as the same reference numbers and characters.

The ignition device shown in FIG. 24 has a spark plug, an ignition coil 3, a controller 4, and a signal transmission section. The controller 4 controls the execution of a main ignition and the continuous spark discharge from the spark plug. The signal transmission section transmits necessary signals to the controller 4. The controller 4 has a main ignition circuit 10 performing the main ignition and an energy supply circuit 11 to perform the continuous spark discharge.

The main ignition circuit 10 operates on the basis of an ignition signal IGT transmitted from an ECU 5 (engine control unit) as the signal transmission circuit. When the ignition signal IGT is switched from a low level to a high level, a current starts to flow in the primary coil of the ignition coil 3. After this, when the ignition signal IGT is switched from the high level to the low level, the current flowing in the primary coil is interrupted, a high voltage is generated in the secondary coil of the ignition coil 3, and the main ignition of the spark plug is initiated.

The energy supply circuit 11 operates on the basis of a discharge continuous signal IGW and a secondary current instruction signal IGA, which shows a secondary current instruction value I2*a*, transmitted from the ECU 5.

When the discharge continuous signal IGW is switched from a low level to a high level, the electric energy supply is started from a negative side (low voltage side) of the primary coil to a positive side (high voltage side) of the primary coil. In a concrete example, the secondary current is maintained at the secondary current instruction value I2*a* by turning on/off of an energy supply switch means.

Next, a description will be given of operation of the ignition device performing the continuous spark discharge with reference to FIG. 25. In FIG. 25, the label "IGT" indicates a high/low signal of the ignition signal IGT, the label "IGW" indicates a high/low signal of the discharge continuous signal IGW, the label "Ignition switch" indicates a turned ON/OFF operation of the ignition switching means, the label "Energy supply switch" indicates the turned ON and OFF operation of the energy supply switch means, the label "I1" indicates the primary current (current value flowing in the primary coil), and the label "I2" indicates the secondary current (current value flowing in the secondary coil).

When the ECU 5 transmits the ignition signal IGT, the ignition switch means is turned ON during a period ΔT1 (from t01 to t02) in which the ignition signal IGT is the high level.

When the ECU 5 outputs the ignition signal IGT, the ignition switching means is turned on during the period ΔT1 (from t01 to t02) in which the ignition signal IGT is at the high level.

After the start of the main ignition of the spark plug the secondary current is attenuated approximately in a saw tooth wave. The ECU 5 outputs the discharge continuous signal IGW before the secondary current is reduced to not more than a predetermined lower current value (to maintain the spark discharge).

When the ECU 5 outputs the discharge continuous signal IGB, the energy supply switch means is turned on and off to supply a part of energy accumulated in a capacitor in the energy supply circuit 11 to the primary coil. This makes it possible for the primary current to flow in the primary coil every turned on of the energy supply switch means. Further, the secondary current continuously flows in the secondary coil in the same direction of the secondary current flowing by the main ignition.

As previously described, the secondary current continuously flows to maintain the spark discharge by controlling the turning on and off of the energy supply switching means.

That is, the secondary current is maintained within the predetermined target range (around I2*a*) during the period ΔT2 (from t03 to t04) in which the discharge continuous signal IGW is at the high level. As a result, the continuous spark discharge can be maintained in the spark plug during the high level of the discharge continuous signal IGW.

(Problems)

The ECU 5 transmits the ignition signal IGT to the main ignition circuit 10, and the discharge continuous signal IGW to the energy supply circuit 11. As shown in FIG. 26, each of the cylinders of the internal combustion engine requires the ignition signal IGT and the discharge continuous signal IGW. It is accordingly necessary for a four cylinder engine to use eight signal lines (four IGT#1 IGT#4 and four IGW#1 to IGW#4) through which the ECU 5 transmits to the controller 4 the ignition signal IGT and the discharge continuous signal IGW to the four cylinders of the engine.

In addition, when the secondary current instruction value I2*a* is varied according to the operation state of the engine, it is necessary to continuously transmit the secondary current instruction signal IGA to the energy supply circuit 11. This case requires an additional signal line to transmit the secondary current instruction signal IGA to the energy supply circuit 11. For example, as shown in FIG. 24, one of three current values (100 mA, 150 mA and 200 mA) is selected as the secondary current instruction value I2*a* according to the operation state of the engine. This case is required to use additional three signal lines of the three current values to transmit the secondary current instruction value I2*a*.

As previously described, the ignition device capable of performing the continuous spark discharge uses additional signal lines to connect the ECU 5 with the controller 4. This structure of the conventional ignition device increases a manufacturing cost thereof.

(Technical References)

Patent document 1 discloses an ignition device having a circuit to perform a multiplex ignition in which a signal line to transmit an ignition signal IGT and a signal line to transmit a discharge continuous signal IGW are provided to each of cylinders of an engine.

Further, patent document 2 discloses a figure which shows one signal line to transmit the discharge continuous signal IGW, but does not show a multiple signal structure and a secondary current instruction value.

CITATION LIST

Patent Literature

[Patent document 1] Japanese patent laid open publication No. JP 2009-52435; and

[Patent document 2] Japanese patent laid open publication No. JP 2006-63973.

SUMMARY OF INVENTION

Technical Problem to be Solved

To address the deficiencies previously described, an aspect of the present invention is to provide an ignition device to be used for internal combustion engines to perform the continuous spark discharge, having a structure with a less number of signal lines and reducing a manufacturing cost.

Solution to Problem

An ignition device for internal combustion engines according to the present invention 1 has a main ignition circuit, an energy supply circuit, a multiplex signal transmission section, and a cylinder signal extraction section. The main ignition circuit performs power supply control of a primary coil of an ignition coil to generate spark discharge in a spark plug. The energy supply circuit supplies electric energy to the primary coil during the spark discharge started by the operation of the main ignition circuit in order to supply a secondary current in a secondary coil of the ignition coil, and to maintain continuously the spark discharge initiated by the operation of the main ignition circuit.

The multiplex signal transmission section generates a multiplex signal (IGWc) in which two cylinder discharge continuous signals (IGW#1 to IGW#4) to be supplied to at least two cylinders are multiplexed, and transmits the generated multiplex signal (IGWc). The cylinder signal extraction section receives the multiplex signal (IGWc) and extracts the cylinder discharge continuous signals (IGW#1 to IGW#4) from the multiplex signal (IGWc) transmitted from the multiplex signal transmission section.

Because the ignition device according to the present invention 1 uses the multiplex signal (IGWc) in which the cylinder discharge continuous signals to be used for the overall cylinders have been multiplexed, it is possible to reduce the number of signal lines to connect the ECU to the controller when the cylinder signal extraction section is arranged in the controller.

The ignition device for internal combustion engines according to the present invention 2 uses an integral signal transmission section and a signal separation section instead of using the multiplex signal transmission section and the cylinder signal extraction section to be used by the ignition device according to the present invention 1 previously described.

The integral signal transmission section generates an integration signal (IGC) for each cylinder. In the integration signal (IGC), the discharge continuous signal (IGW) as the instruction signal of the continuous spark discharge is added to the ignition signal (IGT) as the instruction signal for the main ignition operation of the spark plug. The integral signal transmission section transmits the generated integration signal (IGC) for each cylinder through a signal line.

The signal separation section receives the integration signal for each cylinder transmitted through the signal line, and separates the ignition signal (IGT) and the discharge continuous signal (IGW) from the received integration signal (IGC). The signal separation section outputs the ignition signal (IGT) to the main ignition circuit, and the discharge continuous signal (IGW) to the energy supply circuit.

Because the ignition device according to the present invention 2 uses the integration signal (IGC) in which the discharge continuous signal (IGW) is added to the ignition signal (IGT), when the ECU generates the integration signal (IGC) and the signal separation section is arranged in the controller, it is possible to reduce the number of signal lines connected between the ECU and the controller.

The ignition device according to the present invention 3 has the main ignition circuit, the integration signal transmission section, and the signal separation section. The main ignition circuit performs power supply control of the primary coil of the ignition coil to generate spark discharge from the spark plug. The energy supply circuit supplies electric energy to the primary coil during the spark discharge started by the operation of the main ignition circuit in order to supply the secondary current in the secondary coil of the ignition coil, and to maintain continuously the spark discharge initiated by the operation of the main ignition circuit.

The integral signal transmission section generates the integration signal (IGC) for each cylinder. In the integration signal (IGC), the discharge continuous signal (IGW) as the instruction signal of the continuous spark discharge is added to the ignition signal (IGT) as the instruction signal for the main ignition operation of the spark plug. The integral signal transmission section transmits the generated integration signal (IGC) for each cylinder through the signal line.

The signal separation section receives the integration signal for each cylinder transmitted through the single signal line, and separates the ignition signal (IGT) and the discharge continuous signal (IGW) from the received integration signal (IGC). The signal separation section outputs the ignition signal (IGT) to the main ignition circuit, and the discharge continuous signal (IGW) to the energy supply circuit.

Because the ignition device according to the present invention 3 uses the integration signal (IGC) in which the discharge continuous signal (IGW) is added to the ignition signal (IGT), when the ECU generates the integration signal (IGC) and the signal separation section is arranged in the controller, it is possible to reduce the number of signal lines connected between the ECU and the controller.

DESCRIPTION OF EMBODIMENTS

Hereinafter, various exemplary embodiments to realize the present invention will be explained in detail.

Exemplary Embodiments

Concrete exemplary embodiments according to the present invention will be explained with reference to drawings.

The following exemplary embodiments are a concrete example of the present invention, and the exemplary embodiments do not limit the scope of the present invention.

First Exemplary Embodiment

A description will be given of an ignition device for internal combustion device according to the first exemplary embodiment with reference to FIG. 1 to FIG. 7. The ignition device according to the first exemplary embodiment is mounted on a spark plug engine mounted on a vehicle. The ignition device performs ignition of a mixture gas in a combustion chamber of the internal combustion engine at a predetermined ignition timing (ignition period). The internal combustion engine is a gasoline direct injection engine capable of performing burning of fuel with excess air (lean burn combustion), and the gasoline direct injection engine has a swirling flow control means capable of generating a swirling flow (tumble flow, swirl flow, etc.) in a cylinder of the engine.

The ignition device according to the first exemplary embodiment is a DI (Direct Ignition) type using an ignition coil 3 which corresponds to an ignition plug 1 of each of the cylinders of the engine.

Figure 1:
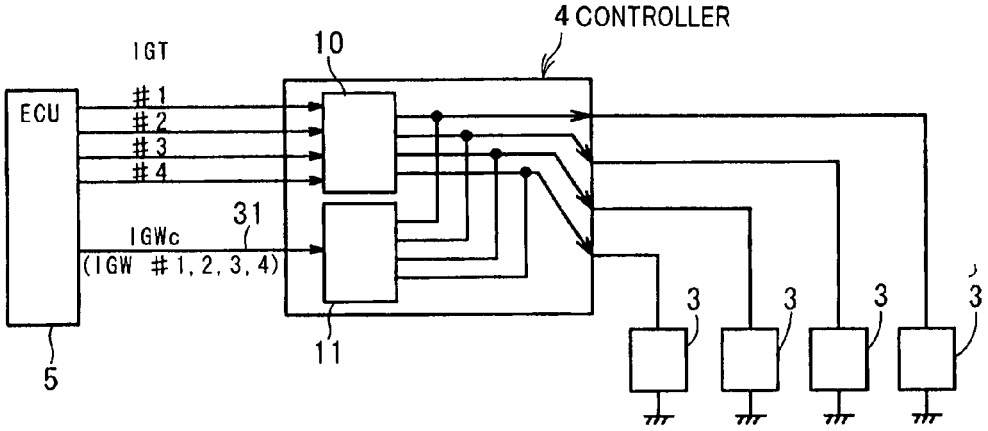
FIG. 1 is a view showing a schematic structure of the ignition device for internal combustion engines according to a first exemplary embodiment of the present invention.
Figure 2:
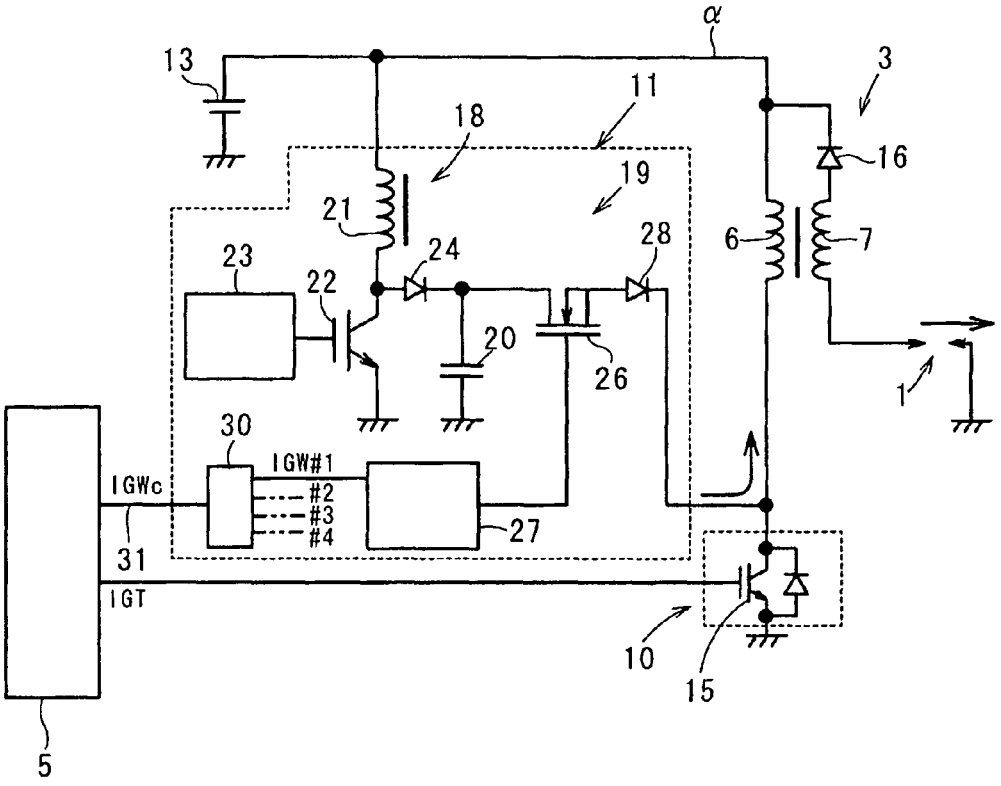
FIG. 2 is a view showing a schematic circuit diagram of the ignition device for internal combustion engines according to a first exemplary embodiment shown in FIG. 1.

A description will now be given of a schematic structure of the ignition device with reference to FIG. 1 and FIG. 2. FIG. 2 is a view explaining a schematic structure of a circuit of the ignition device for one cylinder. The ignition device is equipped with the ignition plug 1, the ignition coil 3, the controller 4 for controlling the main ignition and the continuous spark discharge, and an ECU 5. The ECU 5 transmits necessary signals to the controller 4.

The controller 4 performs a current control of a primary coil 6 of the ignition coil 3 on the basis of instruction signals (ignition signal IGT, discharge continue signal IGW and a secondary current instruction signal IGA) transmitted from the ECU 5. The controller 4 performs the current control of the primary coil 3 to generate electric energy in a secondary coil 7 and perform a spark discharge of the ignition plug 1. The controller 4 has a main ignition circuit 10, and an energy supply circuit 11 which will be explained later. The ECU 5 generates these instruction signals based on engine parameters (a warming-up state, an engine rotation speed, an engine load, etc. obtained by various types of sensors) and a control state of the engine. The ECU 5 transmits the generated instruction signals to the controller 4.

The ignition plug 1 is a known device having a central electrode and an external electrode to generate spark discharge between the central electrode and the external electrode by using electric energy generated in the secondary coil 7. The central electrode is connected to one terminal of the secondary coil 7 of the ignition coil 3 through an output terminal. The external electrode is grounded through a cylinder head, etc. of the engine. The ignition plug 1 is arranged to each of the cylinders of the engine.

The ignition coil 3 has the primary coil 6 and the secondary coil 7. The secondary coil 7 has more coil turns than the primary coil 6.

One terminal of the primary coil 6 is connected to the positive terminal of the ignition coil 3. The positive terminal of the ignition coil 3 is connected to a battery voltage supply line a (through which electric power is supplied from the positive electrode of an in-vehicle battery 13). The other terminal of the primary coil 6 is connected to an earth terminal of the ignition coil 3. The earth terminal of the ignition coil 3 is grounded through an ignition switching means 15 (a power transistor, a MOS transistor, etc.) of the main ignition circuit 10.

As previously described, one terminal of the secondary coil 7 is connected to the output terminal, and the output terminal is connected to the central electrode of the ignition coil 1. The other terminal of the secondary coil 7 is connected to the battery voltage supply line a or earthed. In a concrete example, the other terminal of the secondary coil 7 is connected to the positive terminal of the ignition coil 3 through a first diode 16. The first diode 16 suppresses unnecessary voltage generated when the electric power is supplied to the primary coil 6.

The main ignition circuit 10 is a circuit capable of supplying electric power to the primary coil 6 of the ignition coil 3 to generate the spark discharge in the ignition plug 1. The main ignition circuit 10 supplies a voltage (battery voltage) of the in-vehicle battery 13 to the primary coil 6 during the ignition signal IGT supply period. Specifically, the main ignition circuit 10 has the ignition switching means 15 (power transistor, etc.) capable of supplying electric power to the primary coil 6 and interrupting the electric power supply to the primary coil 6. When receiving the ignition signal IGT, the main ignition circuit 10 turns on the ignition switching means 15 to supply the battery voltage to the primary coil 6.

The ignition signal IGT is an instruction signal (see FIG. 3) to determine the period (the energy accumulation period $\Delta T1$), in which the main ignition circuit 10 accumulates electromagnetic energy in the primary coil 6, and to provide the discharge start timing t02. The ignition signal IGT (IGT#1 to IGT#4) is generated for each of the cylinders.

The energy supply circuit 11 supplies electric power to the primary coil 6 during the spark discharge started by the operation of the main ignition circuit 10 in order to supply the secondary current in the secondary coil 7 in the same direction. The operation of the main ignition circuit 10 can continue the spark discharge started by the operation of the main ignition circuit 10.

The energy supply circuit 11 is comprised of a booster circuit 18 and an energy supply control means 19 which will be explained below.

The booster circuit 18 boosts a voltage of the in-vehicle battery 13 to accumulate the electric energy in the capacitor 20 during the period of the ignition signal IGT transmitted from the ECU 5. The energy supply control means 19 supplies the electric energy accumulated in the capacitor 20 to the negative terminal (the earth side) of the primary coil 6.

The booster circuit 18 is equipped with the capacitor 20, a choke coil 21, a booster switching means 22, a booster driver circuit 23 and a second diode 24. For example, the booster switching means 22 is comprised of an insulated gate bipolar transistor.

One terminal of the choke coil 21 is connected to the positive electrode of the in-vehicle battery 13. The booster switching means 22 turns on and off the choke coil 21. The booster driver circuit 23 transmits a control signal to the booster switching means 22 in order to turn on and off the booster switching means 22. The turning on and off operation of the booster switching means 22 charges the capacitor 20 with the electromagnetic energy accumulated in the choke coil 21. Thereby, the capacitor 20 accumulates the electric energy therein.

The booster driver circuit 23 drives the repetition of turning on and off of the booster switching means 22 every predetermined period in which the ECU 5 transmits the ignition signal IGT. The second diode 24 prevents the supply of the electric energy accumulated in the capacitor 20 to the choke coil 21 side.

The energy supply control means 19 is equipped with an energy supply switching means 26, an energy supply driver circuit 27 and a third diode 28. The energy supply switching means 26 is composed of a MOS transistor, for example.

The energy supply switching means 26 turns on and off the supply of the electric energy accumulated in the capacitor 20 to the negative side (low voltage side) of the primary coil 6. The energy supply driver circuit 27 transmits a control signal to the energy supply switching means 26 to turn on and off.

The energy supply driver circuit 27 turns on and off the energy supply switching means 26 to adjust the electric energy of the capacitor 20 to be supplied to the primary coil 6. This control makes it possible to maintain the secondary current to the secondary current instruction value I2*a* during the period when the energy supply driver circuit 27 receives the discharge continuous signal IGW.

The discharge continuous signal IGW is a signal showing the energy supply timing t03 and the period to continue the spark discharge of the ignition plug 3. More specifically, the discharge continuous signal IGW instructs the energy supply switching means 26 to turn on and off repeatedly during the period (the energy supply period ΔT2) in which the electric energy is supplied from the booster circuit 18 to the primary coil 6. The discharge continuous signal IGW (IGW#1 to IGW#4) is generated for each of the cylinders of the engine. The third diode 28 prevents the supply of the current from the primary coil 6 to the capacitor 20.

In a concrete example of the energy supply driver circuit 27, there is a circuit to perform the turning on and off control of the energy supply switching means 26 by using an open control which maintains the secondary current at the secondary current instruction value I2*a*. There is another circuit to perform a feedback control of the turning on and off state of the energy supply switching means 26 in order to maintain a monitored secondary current at the secondary current instruction value I2*a*.

It is possible to use, as the secondary current instruction value I2*a*, a constant value or a variable value due to the operation state of the engine. The first exemplary embodiment uses an instruction signal as the secondary current instruction signal IGA because of selecting a value from three current values which correspond to the operation state of the engine, and transmits the selected value to the energy supply circuit 11.

(Features of the Ignition Device for Internal Combustion Engines According to the First Exemplary Embodiment)

The ignition device for internal combustion engines according to the first exemplary embodiment has a multiplex signal transmission section and a cylinder signal extraction section 30. In the first exemplary embodiment, the ECU 5 acts as the multiplex signal transmission section. The ECU 5 generates the discharge continuous signals IGW#1 to IGW#4 which are instruction signals to continue the spark discharge in the cylinders, respectively, and multiplexes these signals as a multiplex signal IGWc. The ECU 5 transmits the multiplex signal IGWc to the signal line 31.

The cylinder signal extraction section 30 receives the multiplex signal IGWc transmitted from the multiplex signal transmission section through the signal line 31, and the extracts the discharge continuous signals IGW#1 to IGW#4 for the cylinders of the engine from the multiplex signal IGWc. The cylinder signal extraction section 30 is arranged in the energy supply circuit 11 in the controller 4.

For example, in the structure of the first exemplary embodiment, the energy supply driver circuit 27 is arranged for each of the cylinders of the engine, the cylinder signal extraction section 30 extracts the discharge continuous signals IGW#1 to IGW#4 for each of the cylinders from the multiplex signal IGWc, and transmits each of the discharge continuous signals IGW#1 to IGW#4 to the energy supply driver circuit 27 of the corresponding cylinder. It is acceptable to arrange the energy supply driver circuit 27 for the overall cylinders of the engine, and arrange the cylinder signal extraction section 30 for each of the cylinders in the energy supply driver circuit 27.

Figure 3:
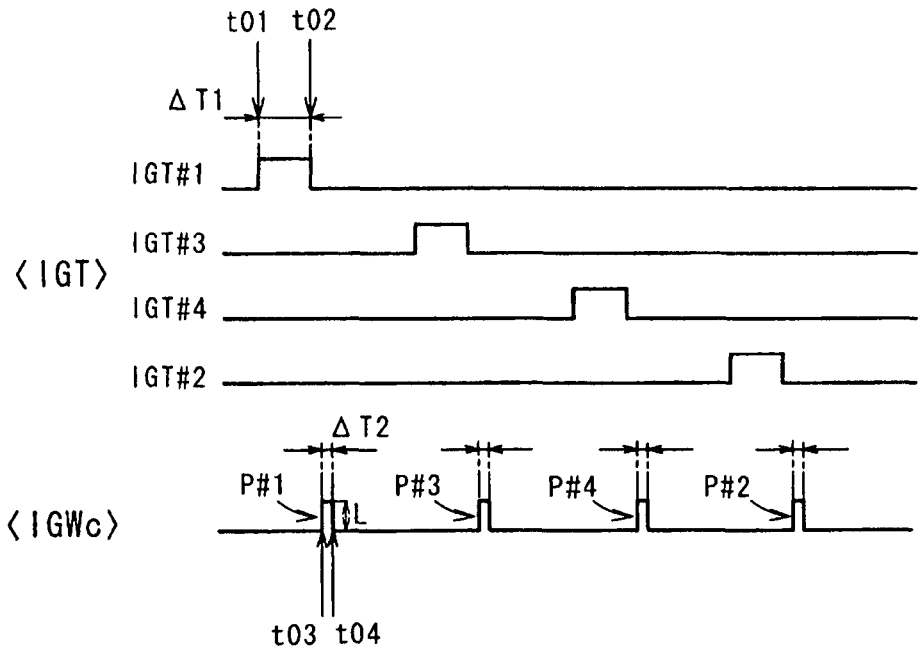
FIG. 3 is a timing chart showing an ignition signal IGT and a multiplexed signal IGWc used by the ignition device for internal combustion engines according to the first exemplary embodiment shown in FIG. 1.
Figure 4:
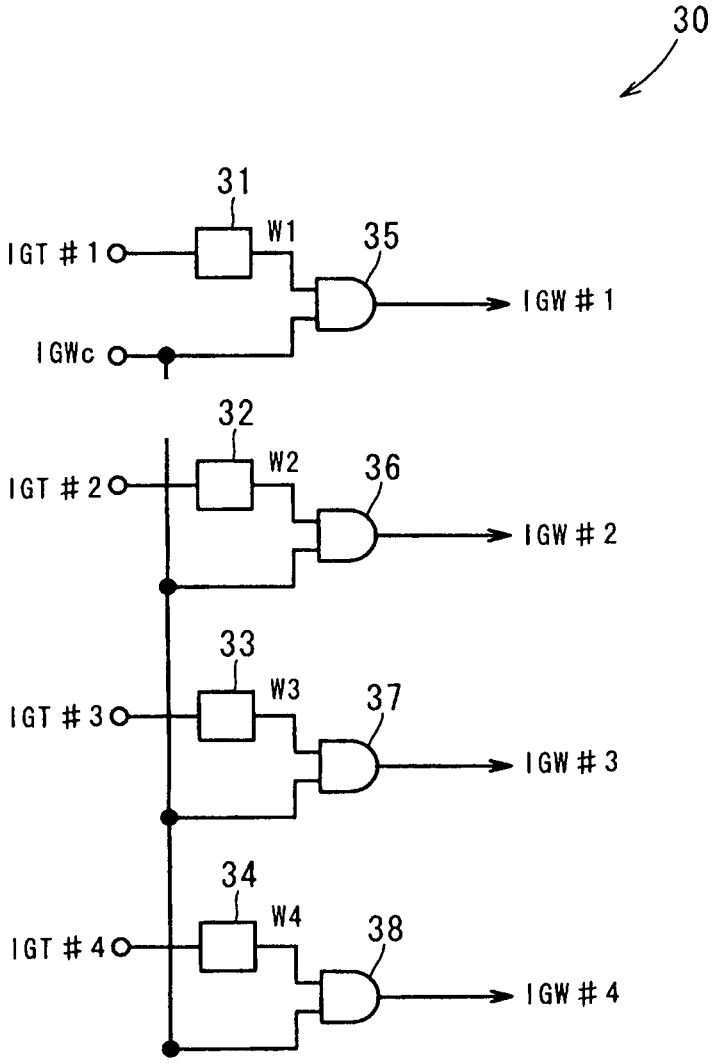
FIG. 4 is a view showing a schematic circuit diagram of a cylinder signal extraction section in the ignition device for internal combustion engines according to the first exemplary embodiment shown in FIG. 1.
Figure 5:
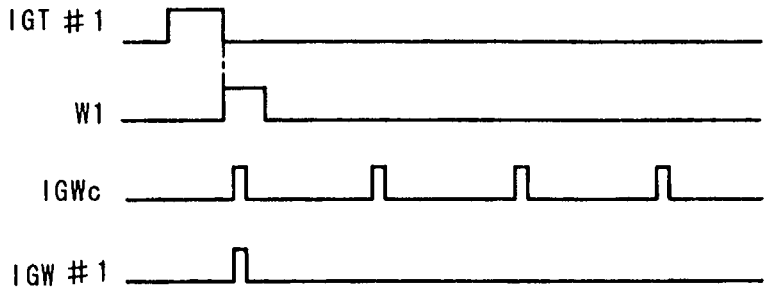
FIG. 5 is a timing chart explaining extraction of cylinder discharge continuous signals IGW#1 IGW#4 by the ignition device for internal combustion engines according to the first exemplary embodiment shown in FIG. 1.
Figure 26:
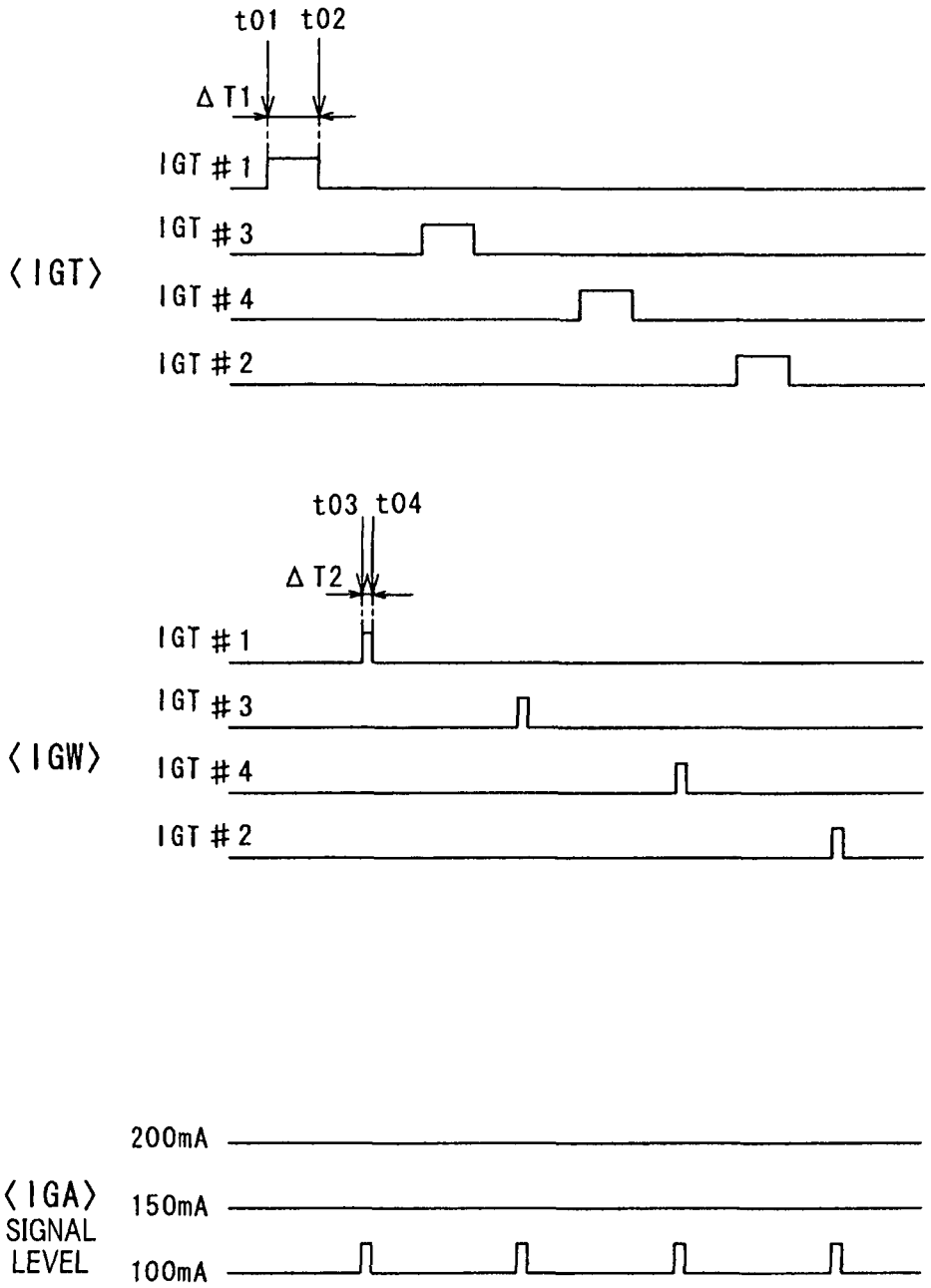
FIG. 26 is a timing chart showing an ignition signal (IGT), a discharge continuous signal (IGW) and a secondary current instruction signal (IGA) transmitted through each of signal lines which are used by the ignition device for internal combustion engines according to the comparison example.

A description will now be given of a concrete example of the multiplex signal IGWc with reference to FIG. 3. As shown in FIG. 26, the discharge continuous signals IGW#1 to IGW#4, each of which corresponds to each of the cylinders of the engine and indicates the signal showing the energy supply timing t03 and the energy supply period ΔT2 for each cylinder. The rising timing in each discharge continuous signal from a low level to a high level corresponds to the energy supply timing t03, and the pulse width thereof corresponds to the energy supply period ΔT2. It is acceptable for each of the discharge continuous signals IGW#1 to IGW#4 to have a different pulse width. The energy supply timing t03 of each of the discharge continuous signals IGW#1 to IGW#4 is determined after the discharge start timing t02 of each of the discharge continuous signals IGW#1 to IGW#4.

The multiplex signal IGWc is formed by multiplexing in time division the pulses of the discharge continuous signals IGW#1 to IGW#4 for the cylinders of the engine in time-division. That is, the pulses P#1 to P#4 corresponding to the cylinders are sequentially outputted in the order of the output of the ignition signals IGT#1 to IGT#4. The rising timing of each of the pulses P#1 to P#4 corresponding to each cylinder is determined corresponding to the energy supply timing t03 of each cylinder.

The height L of the multiplex signal IGWc represents the secondary current instruction signal IGA. This will be explained later in detail.

Next, a description will be given of the extraction operation of the discharge continuous signals IGW#1 to IGW#4 from the multiplex signal IGWc by the cylinder signal extraction section 30.

The cylinder signal extraction section 30 contains timer circuits 31 to 34 and AND circuits 35 to 38. Each of the timer circuits 31 to 34 outputs a high level signal during a predetermined period counted from the falling edge of each of the ignition signals IGT#1 to IGT#4. This predetermined period is 2 ms, for example, so as to be longer than the maximum time of the energy supply period ΔT2. The AND circuit 35 performs a logical product of the output W1 transmitted from the timer circuit 31 and the multiplex signal IGWc so as to extract the discharge continuous signal IGW#1 for the first cylinder (see FIG. 5).

Similarly, the AND circuit 36 performs a logical product of the output W2 transmitted from the timer circuit 32 and the multiplex signal IGWc so as to extract the discharge continuous signal IGW#2 for the second cylinder.

The AND circuit 37 performs a logical product of the output W3 transmitted from the timer circuit 33 and the multiplex signal IGWc so as to extract the discharge continuous signal IGW#3 for the third cylinder. The AND circuit 38 performs a logical product of the output W4 transmitted from the timer circuit 34 and the multiplex signal IGWc so as to extract the discharge continuous signal IGW#4 for the fourth cylinder.

The discharge continuous signals IGW#1 to IGW#4 for the first to fourth cylinders are transmitted to the corresponding energy supply driver circuits 27 for the first to fourth cylinders, respectively.

Figure 6:
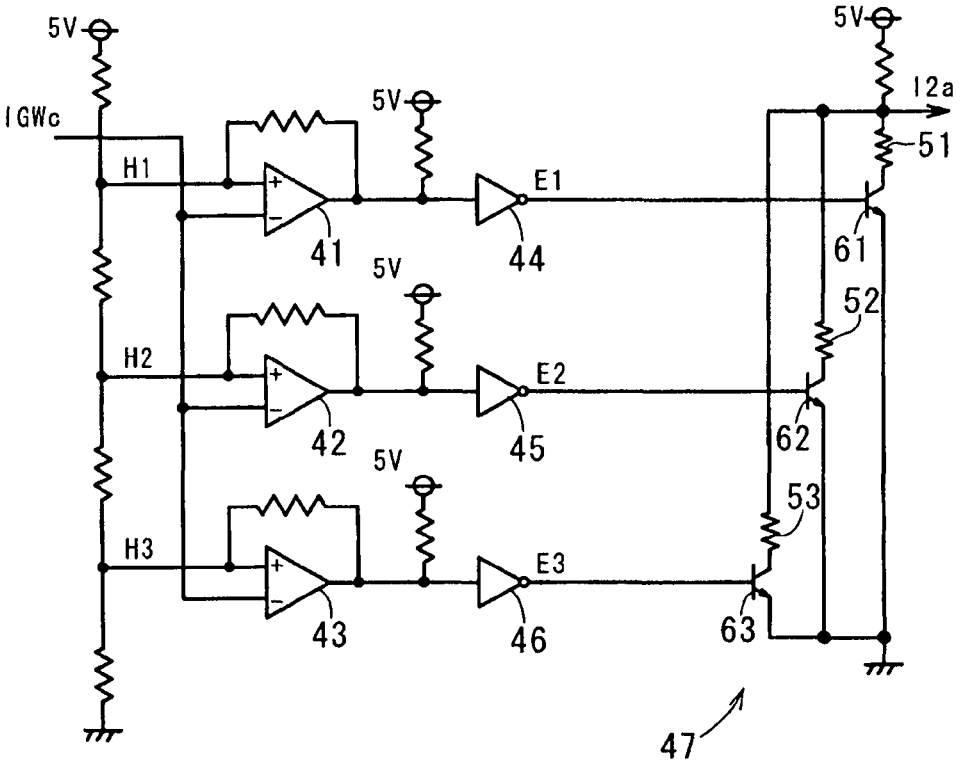
FIG. 6 is a view showing a schematic circuit diagram of a partial section capable of extracting a secondary current instruction signal IGA in the ignition device for internal combustion engines according to the first exemplary embodiment shown in FIG. 1.
Figure 7:
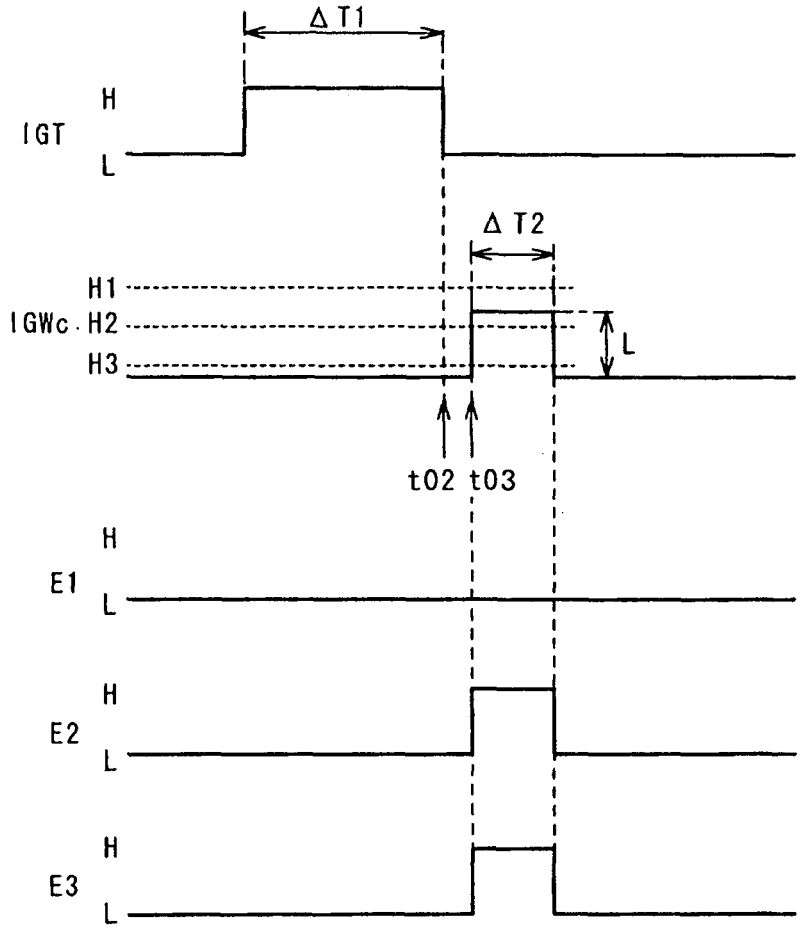
FIG. 7 is a timing chart explaining the extraction of the secondary current instruction signal by the ignition device for internal combustion engines according to the first exemplary embodiment shown in FIG. 1.

Next, a description will be given of the addition of the secondary current instruction signal IGA to the multiplex signal IGWc with reference to FIG. 6 and FIG. 7.

In the first exemplary embodiment, the height L of the high level of the multiplex signal IGWc represents the secondary current instruction signal IGA. That is, as shown in FIG. 7, the secondary current instruction signal IGA is extracted as one of the three current values on the basis of the fact whether or not the height of the high level of the multiplex signal IGWc is not less than each of threshold values H1 to H3.

Specifically, when the multiplex signal IGWc indicates the secondary current instruction value I2*a* of 200 mA, the height of the multiplex signal IGWc is determined to be less than the threshold value H2 and not less than the threshold value H3. When the multiplex signal IGWc indicates the secondary current instruction value I2*a* of 150 mA, the height of the multiplex signal IGWc is determined to be less than the threshold value H1 and not less than the threshold value H2. Further, when the multiplex signal IGWc indicates the secondary current instruction value I2*a* of 100 mA, the height of the multiplex signal IGWc is determined to be not less than the threshold value H1. That is, when the height of the multiplex signal IGWc is not less than the threshold value H1, the multiplex signal IGWc indicates that the secondary current instruction value I2*a* is 100 mA. When the height of the multiplex signal IGWc is less than the threshold value H1 and not less than the threshold value H2, the multiplex signal IGWc indicates that the secondary current instruction value I2*a* is 150 mA. When the height of the multiplex signal IGWc is less than the threshold value H2 and not less than the threshold value H3, the multiplex signal IGWc indicates that the secondary current instruction value I2*a* is 200 mA. Accordingly, the height of the multiplex signal IGWc corresponds to the secondary current instruction signal IGA.

A description will now be given of the extraction circuit of extracting the secondary current instruction value I2*a* from the secondary current instruction signal IGA with reference to FIG. 6. This extraction circuit is comprised of comparators 41 to 43, NOT circuits 44 to 46, an analogue output circuit 47, etc.

The comparator 41 compares the multiplex signal IGWc with the threshold value H1. When the comparison result indicates that the multiplex signal IGWc is higher than the threshold value H1, the comparator 41 outputs an output signal of a low level. The NOT circuit 44 inverts the output signal of the comparator 41 to extract a signal E1. This signal E1 becomes a high level when the secondary current instruction value I2*a* is 100 mA.

The comparator 42 compares the multiplex signal IGWc with the threshold value H2. When the comparison result indicates that the multiplex signal IGWc is higher than the threshold value H2, the comparator 42 outputs an output signal of a low level. The NOT circuit 45 inverts the output signal of the comparator 42 to extract a signal E2. This signal E2 becomes a high level when the secondary current instruction value I2*a* is 100 mA or 150 mA.

The comparator 43 compares the multiplex signal IGWc with the threshold value H3. When the comparison result indicates that the multiplex signal IGWc is higher than the threshold value H3, the comparator 43 outputs an output signal of a low level. The NOT circuit 46 inverts the output signal of the comparator 43 to extract a signal E3. This signal E3 becomes a high level when the secondary current instruction value I2*a* is 100 mA, 150 mA or 200 mA.

The analogue output circuit 47 is composed of resistances 51 to 53, first to third switching elements 61 to 63, etc. The resistances 51 to 53 are connected parallel to each other. The first to third switching elements 61 to 63 are connected in series to the resistances 51 to 53, respectively.

The first switching element 61 is turned on when the signal E1 is at a high level, and turned off when the signal E1 is at a low level. The second switching element 62 is turned on when the signal E2 is at a high level, and turned off when the signal E2 is at a low level. The third switching element 63 is turned on when the signal E3 is at a high level, and turned off when the signal E3 is at a low level.

That is, when the signal E1 is at the low level, the signal E2 is at the low level and the signal E3 is at the high level, only the third switching element 63 is turned on. When the signal E1 is at the low level, the signal E2 is at the high level and the signal E3 is at the high level, the second switching element 62 and the third switching element 63 are turned on simultaneously. Further, when the signal E1 is at the high level, the signal E2 is at the high level and the signal E3 is at the high level, all of the first switching element 61, the second switching element 62 and the third switching element 63 are turned on simultaneously.

Each of the resistances 51 to 53 has a resistance value so as to output a current of 200 mA when only the third switching element 63 is turned on, so as to output a current of 150 mA when both the second switching element 62 and the third switching element 63 are turned on, and so as to output a current of 100 mA when all of the first switching element 61, the second switching element 62 and the third switching element 63 are turned on. Accordingly, the signals E1 to E3 are extracted from the secondary current instruction signal IGA which is an instruction signal to select one of the three current values and output the selected current value to the energy supply circuit 11. Actually, the analogue output circuit 47 outputs the secondary current instruction value I2*a* based on the signals E1 to E3.

(Effects of the Ignition Device for Internal Combustion Engines According to the First Exemplary Embodiment)

The ignition device for internal combustion engines according to the first exemplary embodiment has the multiplex signal transmission section and the cylinder signal extraction section 30. The multiplex signal transmission section outputs the multiplex signal IGWc obtained by multiplexing the discharge continuous signals IGW#1 to IGW#4 for the cylinders of the engine. The cylinder signal extraction section 30 extracts the discharge continuous signals IGW#1 to IGW#4 from the multiplex signal IGWc transmitted from the multiplex signal transmission section.

According to the structure shown in the first exemplary embodiment, because the ECU 5 generates the multiplex signal IGWc and the cylinder signal extraction section 30 is arranged in the controller 4, it is possible to reduce the number of the signal lines between the ECU 5 and the controller 4. That is, this structure requires only the signal line 31 which is commonly used, but does not require the signal lines corresponding to the number of the cylinders of the engine to transmit the discharge continuous signals IGW#1 to IGW#4 corresponding to the cylinders. In addition to this effect, because of using the multiplex signal IGWc including the secondary current instruction signal IGA, this structure does not require a dedicated signal line to transmit the secondary current instruction signal IGA. Accordingly, it is possible for this structure of the ignition device of the first exemplary embodiment to reduce the total number of the signal lines between the ECU 5 and the controller 4.

Second Exemplary Embodiment

Figure 8:
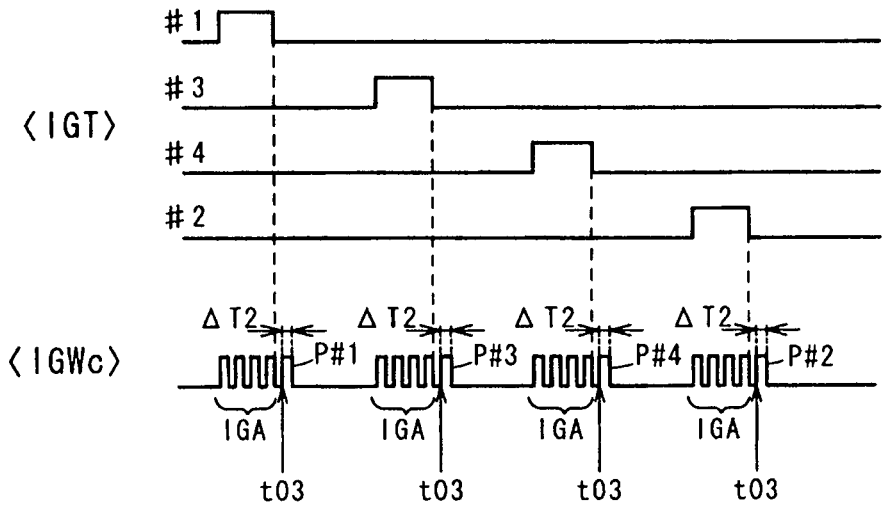
FIG. 8 is a timing chart showing the ignition signal IGT and the multiplexed signal IGWc used by the ignition device for internal combustion engines according to a second exemplary embodiment of the present invention.

A description will be given of the ignition device for internal combustion engines according to the second exemplary embodiment with reference to FIG. 8. The same components between the second exemplary embodiment and the first exemplary embodiment will be referred with the same reference numbers. The second exemplary embodiment uses an addition method of adding the secondary current instruction signal IGA into the multiplex signal IGWc, which is different from the addition method previously explained in the first exemplary embodiment. In the ignition device for internal combustion engines according to the second exemplary embodiment, the current value is determined on the basis of a PWM during the high level of the ignition signal IGT. It is possible for the ignition device according to the second exemplary embodiment to have the same effects and behavior of the ignition device according to the first exemplary embodiment. In addition, it is possible for the ignition device according to the second exemplary embodiment to use a variable current instruction value.

Third Exemplary Embodiment

Figure 9:
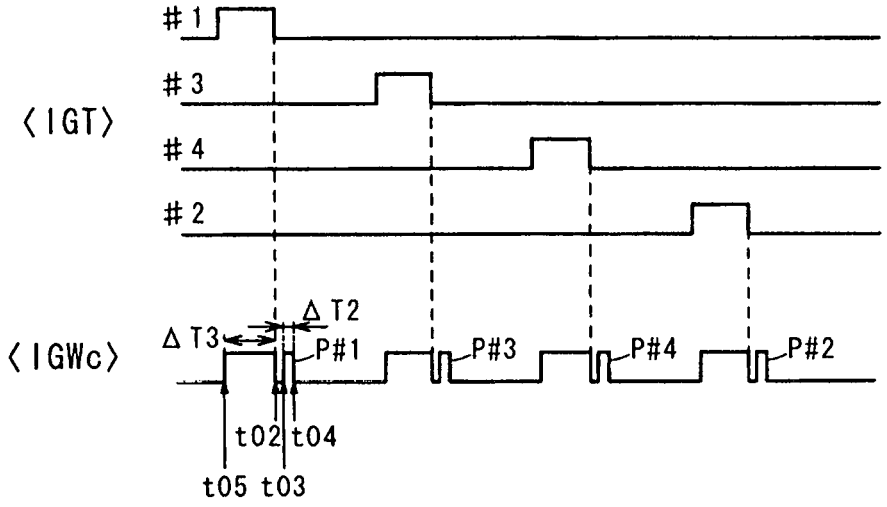
FIG. 9 is a timing chart showing the ignition signal IGT and the multiplexed signal IGWc used by the ignition device for internal combustion engines according to a third exemplary embodiment of the present invention.
Figure 10:
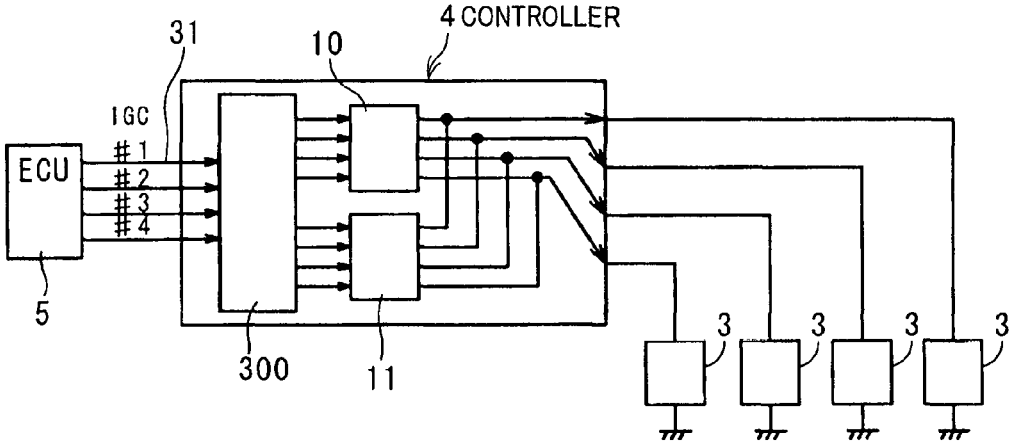
FIG. 10 is a view showing a schematic structure of the ignition device for internal combustion engines according to a fourth exemplary embodiment of the present invention.
Figure 11:
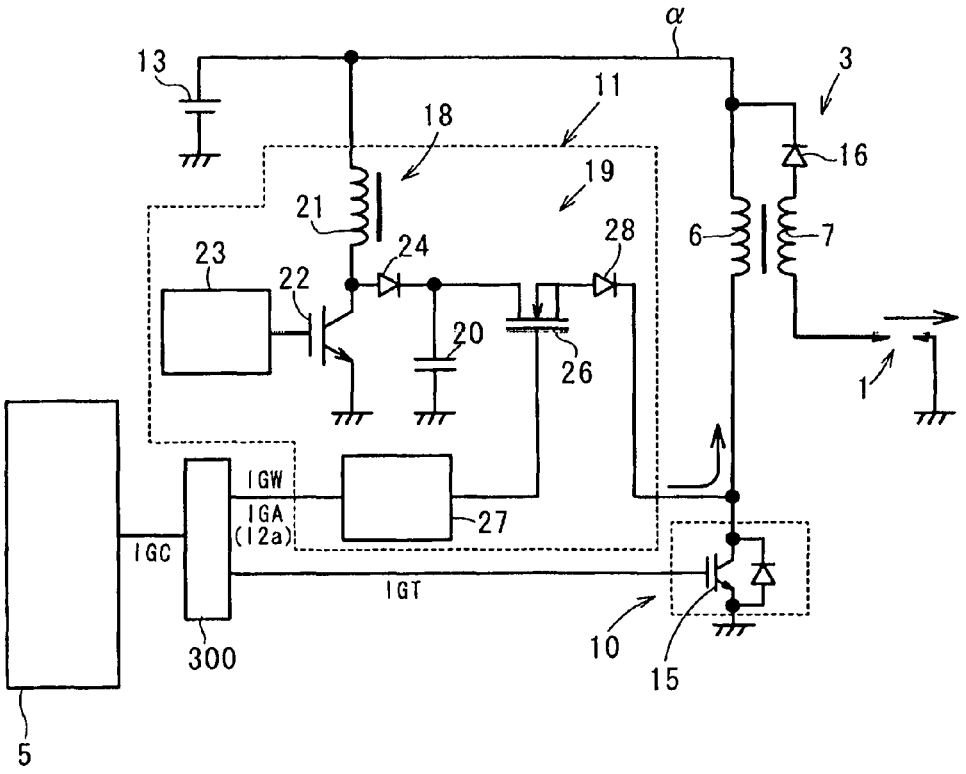
FIG. 11 is a view showing a schematic structure of the ignition device according to the fourth exemplary embodiment of the present invention for controlling a cylinder of the internal combustion engine.

A description will be given of the ignition device for internal combustion engines according to the third exemplary embodiment with reference to FIG. 9. The same components between the third exemplary embodiment and the first exemplary embodiment will be referred with the same reference numbers. The third exemplary embodiment uses a method of adding the secondary current instruction signal IGA into the multiplex signal IGWc which is different from the addition method used by the first exemplary embodiment.

In the ignition device for internal combustion engines according to the third exemplary embodiment, the current value is determined on the basis of a rising timing of the multiplex signal IGWc as the discharge continuous signal during the high level of the ignition signal IGT. For example, on the basis of the period ΔT3 in which the multiplex signal IGWc is at a high level counted from the rising timing T05 to the falling timing t02. It is possible for the ignition device according to the third exemplary embodiment to have the same effects and behavior of the ignition device according to the first exemplary embodiment. In addition, it is possible for the ignition device according to the third exemplary embodiment to use a variable current instruction value.

As previously described, the ignition device according to the third exemplary embodiment uses the multiplex signal IGWc which rises at the timing t05, falls at the timing t02, rises again at the timing t03, and falls again at the timing t04. It is also possible for the ignition device according to the third exemplary embodiment uses another multiplex signal IGWc which rises at the timing t05 and falls at the timing t04 only. In the latter case, the controller 4 generates the timing t03 on the basis of the timing t02.

Fourth Exemplary Embodiment

A description will be given of the ignition device for internal combustion engines according to the fourth exemplary embodiment with reference to FIG. 10 to FIG. 15.

Similar to the structure of the ignition device according to the first exemplary embodiment, the ignition device according to the fourth exemplary embodiment is equipped with the ignition plug 1, the ignition coil 3, the ECU 5 and the controller 4 which controls the process of the main ignition and the continuous spark discharge. Because each of these components in the ignition device according to the fourth exemplary embodiment has the same structure of those of the ignition device according to the first exemplary embodiment, the explanation of the same components is omitted here.

In the ignition device according to the first exemplary embodiment, the signals to be used for the cylinders are integrated in order to reduce the total number of the signal lines. On the other hand, in the ignition device according to the fourth exemplary embodiment, different types of signals are integrated together to reduce the total number of the signal lines. That is, the first to fourth exemplary embodiment have the same concept of the present invention to transmit a plurality of signals through the single signal line, and for the controller 4 to read the transmitted signals. Hereinafter, the ignition device according to the fourth exemplary embodiment will be explained in detail.

The ECU 5 forms the integration signal transmission section for transmitting the integration signal IGC which includes the ignition signal IGT, the discharge continuous signal IGW and the secondary current instruction signal IGA, which correspond to engine parameters and an engine control state.

The engine parameters represent a warming-up state, an engine rotation speed, an engine load, etc., and the engine control state represents whether a lean burn combustion occurs or does not occur, a state of tumble flow, swirl flow, etc. in a cylinder of the engine.

A signal separation section 300 is arranged in the controller 4, and capable of separating the ignition signal IGT, the discharge continuous signal IGW and the secondary current instruction signal IGA from the integration signal IGC. The signal separation section 300 outputs the ignition signal IGT separated from the integration signal IGC to the main ignition section 10. Further, the signal separation section 300 outputs the discharge continuous signal IGW and the secondary current instruction signal IGA separated from the integration signal IGC to the energy supply section 11.

Figure 12:
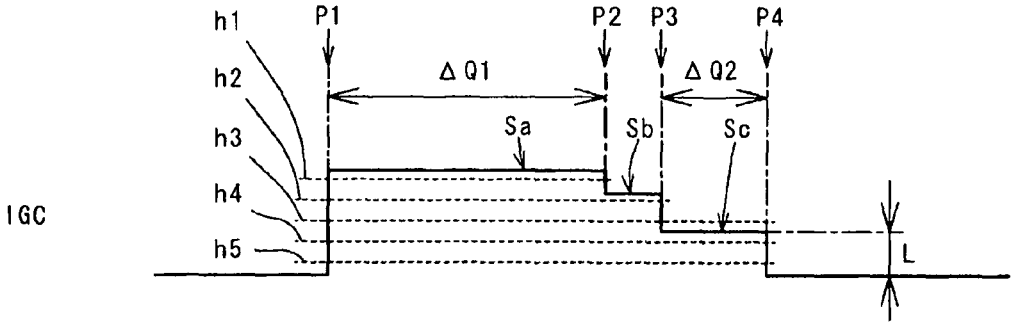
FIG. 12 is a view of explaining a signal pattern of an integration signal used by the ignition device for internal combustion engines according to the fourth exemplary embodiment of the present invention.

A description will be given of the concrete example of the integration signal IGC with reference to FIG. 12. The following explanation regards to the integration signal IGC for the first cylinder of the engine. The integration signal IGC has a stair structure comprising a plurality of signal levels in which three signal levels are time-changed stepwise. That is, the high level of the integration signal IGC is composed of a first high-level signal Sa, a second high-level signal Sb and a third high-level signal Sc which are changed in the time elapsed and will be explained below.

At a predetermined timing P1, the signal separation section 300 outputs the first high-level signal Sa which exceeds a threshold value h1. After the first high-level signal Sa is maintained during a predetermined period ΔQ1, the signal separation section 300 reduces the signal level stepwise at a predetermined timing P2, and outputs the second high-level signal Sb which is not more than the threshold value h1 and exceeds the threshold value h2.

After the second high-level signal Sb is maintained during a predetermined period, the signal separation section 300 further reduces the signal level of the integration signal IGC at a predetermined timing P3, and outputs the third high-level signal Sc which is not more than the threshold value h2 and exceeds one of the threshold values h3 to h5. After maintaining the third high-level signal Sc during a predetermined period ΔQ2, the signal separation section 300 outputs the integration signal IGC of a low-level (OFF) at a predetermined timing P4.

In the integration signal IGC having the stair structure, the timing P2 (change point of the signal level) corresponds to the OFF timing (discharge start timing t02) of the ignition signal IGT. In addition, the timing P1 corresponds to the ON timing t01 of the ignition signal IGT. The timing P3 (as the change point of the signal level) corresponds to the ON timing (the energy supply timing t03) of the discharge continuous signal IGW. The predetermined period ΔQ2 corresponds to the turned-on continuous period (the energy supply period ΔT2) of time of the discharge continuous signal IGW. The timing P4 corresponds to the turned-off timing t04 of the discharge continuous signal IGW.

The height L of the third high-level signal Sc corresponds to the secondary current instruction signal IGA. That is, the signal separation section 300 extracts the secondary current instruction signal IGA having the current value selected from the three current values on the basis of the threshold values h3 to h5.

Specifically, the integration signal IGC has a signal level of less than the threshold value h4 and not less than the threshold value h5 when the secondary current instruction value I2*a* is 200 mA. The integration signal IGC has a signal level of less than the threshold value h3 and not less than the threshold value h4 when the secondary current instruction value I2*a* is 150 mA. The integration signal IGC has a signal level of less than the threshold value h2 and not less than the threshold value h3 when the secondary current instruction value I2*a* is 100 mA. That is, when the signal level is less than the threshold value h2 and not less than the threshold value h3, the integration signal IGC shows that the secondary current instruction value I2*a* is 100 mA. When the signal level is less than the threshold value h3 and not less than the threshold value h4, the integration signal IGC shows that the secondary current instruction value I2*a* is 150 mA. Further, when the signal level is less than the threshold value h4 and not less than the threshold value h5, the integration signal IGC shows that the secondary current instruction value I2*a* is 200 mA. Accordingly, the height L of the signal level of the third high-level signal Sc corresponds to the signal showing the secondary current instruction signal IGA.

Figure 13:
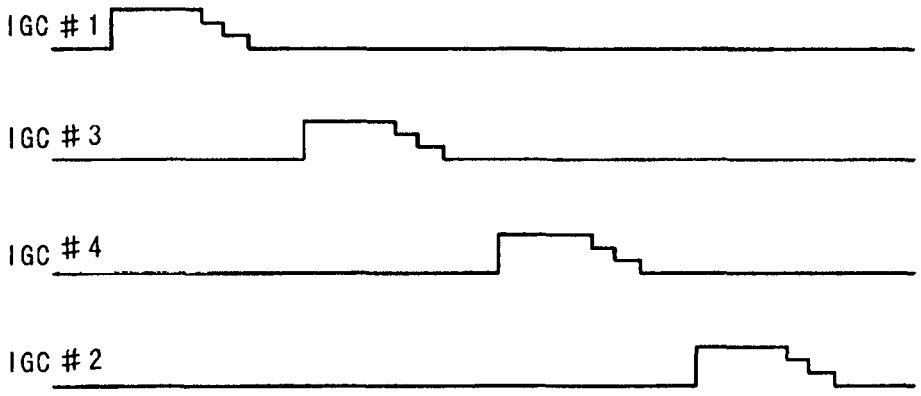
FIG. 13 is a timing chart showing the integration signal used by the ignition device according to the fourth exemplary embodiment of the present invention.

As shown in FIG. 13, the integration signal IGC is generated as the signals IGC#1 to IGC#4 for the corresponding cylinders, respectively, and transmitted to the controller 4. Each of the integration signals IGC#1 to IGC#4 has a different phase which is shifted to each other corresponding to the ignition timing of each cylinder.

Figure 14:
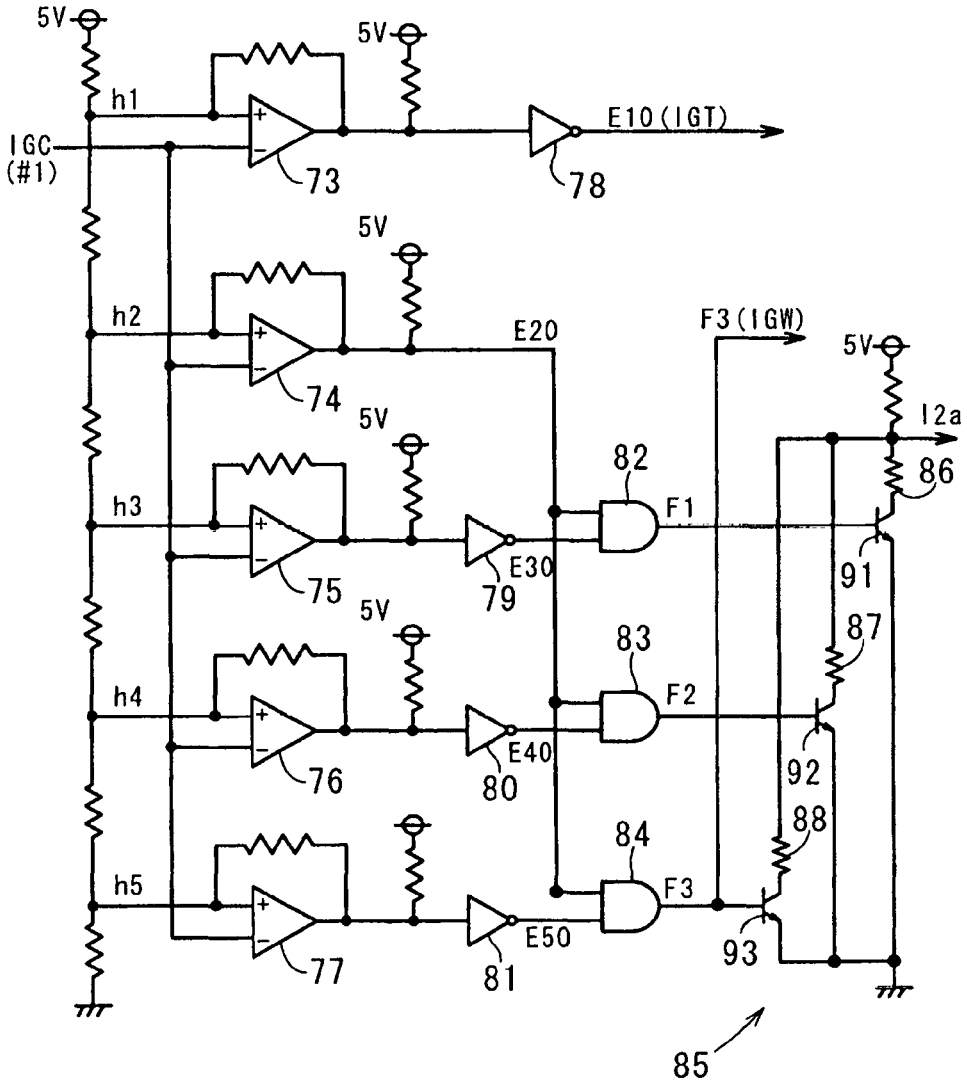
FIG. 14 is a view showing a schematic structure of a signal separation section in the ignition device for internal combustion engines according to the fourth exemplary embodiment of the present invention.
Figure 15:
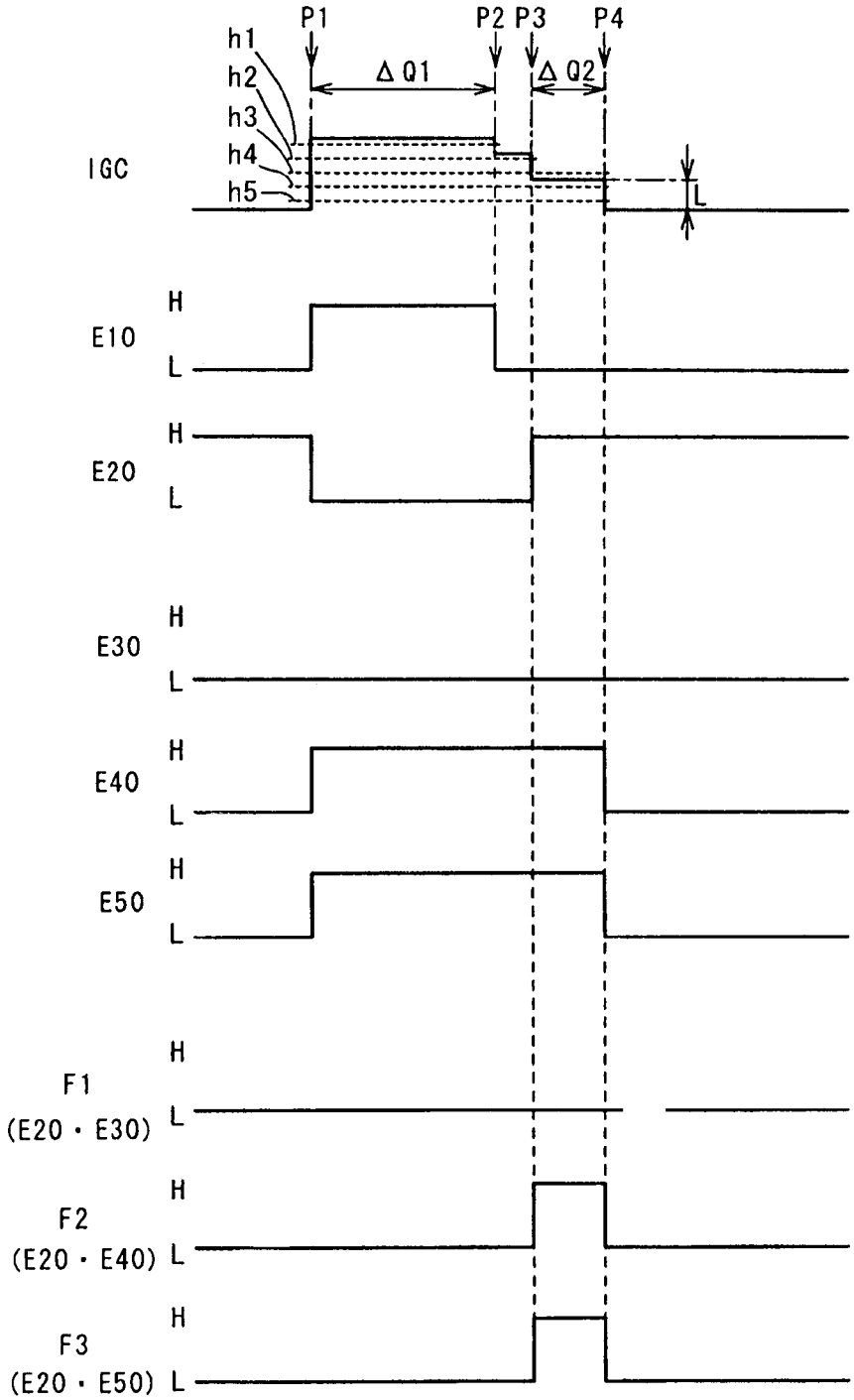
FIG. 15 is a timing chart showing a signal separation by the ignition device according to the fourth exemplary embodiment of the present invention.

Next, a description will be given of the signal separation of the integration signal IGC performed by the signal separation section 300 in the ignition device for internal combustion engines according to the fourth exemplary embodiment with reference to FIG. 14 and FIG. 15. The signal separation of the integration signal ICG for the first cylinder will be explained below.

The signal separation section 300 is composed of comparators 73 to 77, NOT circuits 78 to 81, AND circuits 82 to 84, an analogue output circuit 85, etc.

The comparator 73 compares the integration signal IGC with the threshold value h1, and outputs a low level signal when the integration signal IGC is higher than the threshold value h1. The NOT circuit 78 inverts the output of the comparator 73 to extract a signal E10.

The high-level period ΔQ1 of this signal E10 becomes the energy accumulation period ΔT1, and the timing P2 from the high level to the low level corresponds to the discharge start timing t02. That is, the signal E10 can be used as the ignition signal IGT. Accordingly, the ignition signal IGT is extracted from the integration signal IGC and outputs the extracted ignition signal IGT to the main ignition circuit 10.

The comparator 74 compares the integration signal IGC with the threshold value h2, and outputs the signal E20 of a low level signal when the integration signal IGC is higher than the threshold value h2.

The comparator 75 compares the integration signal IGC with the threshold value h3, and outputs a low level signal when the integration signal IGC is higher than the threshold value h3. The NOT circuit 79 inverts the low level signal transmitted from the comparator 75 to generate a signal E30.

The comparator 76 compares the integration signal IGC with the threshold value h4, and outputs a low level signal when the integration signal IGC is higher than the threshold value h4. The NOT circuit 80 inverts the low level signal transmitted from the comparator 76 to generate a signal E40.

The comparator 77 compares the integration signal IGC with the threshold value h5, and outputs a low level signal when the integration signal IGC is higher than the threshold value h5. The NOT circuit 80 inverts the low level signal transmitted from the comparator 76 to generate a signal E50.

The AND circuit 82 performs a logical product of the signal E20 and the signal E30 to generate a signal F1. The signal F1 is at a high level when the secondary current instruction value I2*a* is 100 mA.

The AND circuit 83 performs a logical product of the signal E20 and the signal E40 to generate a signal F2. The generated signal F2 becomes a high level when the secondary current instruction value I2*a* is 100 mA or 150 mA. The AND circuit 84 performs a logical product of the signal E20 and the signal E50 to generate a signal F3. The generated signal F3 becomes a high level when the secondary current instruction value I2*a* is 100 mA, 150 mA or 200 mA.

The predetermined period ΔQ2, in which the signals F2 and F3 have a high level, corresponds to the energy supply period ΔT2. The timing P3, at which the signals F2 and F3 are switched to the high level from the low level, corresponds to the energy supply timing t03, i.e. corresponds to the discharge continuous signal IGW.

Accordingly, the signal separation section 300 extracts the signal F3, which is at the high level every secondary current instruction value I2*a*, as the discharge continuous signal IGW, and outputs the discharge continuous signal IGW to the energy supply circuit 11.

The analogue output circuit 85 is composed of first to fourth resistances 86 to 88 connected parallel to each other, first to fourth switching elements 91 to 93, etc. The switching elements 91 to 93 are connected in series to the resistors 86 to 88, respectively.

The first switching element 91 is turned ON when the signal F1 is at the high level, and turned OFF when the signal F1 has the low level. The second switching element 92 is turned ON when the signal F2 is at the high level, and turned OFF when the signal F2 has the low level. The third switching element 93 is turned ON when the signal F3 is at the high level, and turned OFF when the signal F3 has the low level.

Only the third switching element 93 is turned ON when the signal F1 has the low level, the signal F2 has the low level and the signal F3 is at the high level, and turned OFF when the signal F3 has the low level. Further, both the second switching element 92 and the third switching element 93 are turned ON when the signal F1 is at the low level, the signal F2 is at the high level and the signal F3 is at the high level. All of the first switching element 91, the second switching element 92 and the third switching element 93 are turned ON when the signal F1 is at the high level, the second signal F2 is at the high level and the third signal F3 is at the high level.

Each of the resistances 86 to 88 has a resistance value so as to output a current of 200 mA when only the third switching element 93 is turned ON, so as to output a current of 150 mA when both the second switching element 92 and the third switching element 93 are turned ON, and so as to output a current of 100 mA when all of the first switching element 91, the second switching element 92 and the third switching element 93 are turned ON. Accordingly, the signals F1 to F3 are extracted from the secondary current instruction signal IGA which is an instruction signal to select one of the three current values and output the selected current value to the energy supply circuit 11. Actually, the analogue output circuit 85 outputs the secondary current instruction value I2*a* based on the signals F1 to F3.

Effects of the Fourth Exemplary Embodiment

In the structure of the ignition device for internal combustion engines according to the fourth exemplary embodiment, the ECU 5 corresponds to the integration signal transmission section capable of outputting the integration signal IGC in which the ignition signal IGT, the discharge continuous signal IGW and the secondary current instruction signal IGA are integrated. In addition, the signal separation section 300 is arranged in the controller 4. The signal separation section 300 extracts the ignition signal IGT, the discharge continuous signal IGW and the secondary current instruction signal IGA from the integration signal IGC. The signal separation section 300 outputs the ignition signal IGT extracted from the integration signal IGC to the main ignition circuit 10, and outputs the discharge continuous signal IGW and the secondary current instruction signal IGA to the energy supply circuit 11.

That is, the ignition device according to the fourth exemplary embodiment uses the integration signal IGC in which the discharge continuous signal IGW and the secondary current instruction signal IGA are added to the ignition signal IGT. Because the signal separation section 300 is arranged in the controller 4, it is possible for the ECU 5 to generate the integration signal IGC and transmit the generated integration signal IGC only through the signal line 31 between the ECU 5 and the controller 4. That is, this structure makes it possible to eliminate the signal lines to be used for transmitting the ignition signal IGT and the discharge continuous signal IGW to each of the cylinders of the engine. Furthermore, this structure makes it possible to eliminate the signal line to transmit the secondary current instruction signal IGA. This structure makes it possible to reduce the total number of the signal is lines arranged between the ECU 5 and the controller 4.

Fifth Exemplary Embodiment

A description will be given of the ignition device for internal combustion engines according to the fifth exemplary embodiment with reference to FIG. 16 and FIG. 17. The difference between the fifth exemplary embodiment and the fourth exemplary embodiment will be explained below.

A description will be given of a concrete example of the integration signal IGC to be used for the first cylinder of the engine in the ignition device according to the fifth exemplary embodiment with reference to FIG. 16.

The integration signal IGC to be used by the ignition device according to the fifth exemplary embodiment rises from a low level to a high level at a timing P10, and then falls from the high level to the low level at a timing P20. After this, the integration signal IGC rises again from the low level to the high level at a timing P30, and then falls from the high level to the low level at a timing P40.

In the integration signal IGC, the timing P10 corresponds to the ON timing t01 of the ignition signal IGT. The period ΔQ10 counted from the timing P10 to the timing P20 corresponds to the ON continuous period (the energy accumulation period ΔT1) of the ignition signal IGT. The timing P20 corresponds to the OFF timing (discharge start timing t02) of the ignition signal IGT.

In addition, the timing P30 corresponds to the ON timing (the energy supply timing t03) of the discharge continuous signal IGW. The period ΔQ20 counted from the timing P30 to the timing P40 corresponds to the ON continuous period (the energy supply period ΔT2) of the discharge continuous signal IGW. The timing P40 corresponds to the OFF timing t04 of the discharge continuous signal IGW.

The secondary current instruction signal IGA is determined on the basis of the height L of the signal level during the period ΔQa counted from the timing T10 to the timing P10*a* in the period ΔQ10.

Next, a description will be given of each signal extraction from the integration signal IGC by the ignition device according to the fifth exemplary embodiment. The ON timing t01 of the ignition signal IGT is detected on the basis of the P10 which is a first rising timing of the integration signal IGC. After the timing P10, the timing P20 is detected as the falling timing of the integration signal IGC. The timing P20 corresponds to the OFF timing t02 of the ignition signal IGT. It is possible to extract the pulse (the ignition signal IGT) of the high level at the timing t01 and the low level at the timing t01 because of detecting both the timing t01 and the timing t02.

When detecting the timing P30 as a rising timing which follows the timing P20 of the integration signal IGC, the ON timing t03 of the discharge continuous signal IGW is obtained. When detecting the timing P40 as the rising timing which follows the timing P30 of the integration signal IGC, the OFF timing t04 of the discharge continuous signal IGW is obtained.

That is, because of obtaining both the ON timing t03 and OFF timing t04 of the discharge continuous signal IGW, it is possible to extract the pulse (the discharge continuous signal IGW) of the high level at the ON timing t03 and the low level at the OFF timing t04.

When detecting whether or not the signal level of the integration signal IGC during the period ΔQa is not less than each of the threshold values h30 to h50, it is possible to extract the secondary current instruction signal IGA which corresponds to one selected from the three current values.

The ignition device for internal combustion engines according to the fifth exemplary embodiment has the same effects of the ignition device according to the fourth exemplary embodiment. In the ignition device according to the fifth exemplary embodiment, the height of the signal level of the integration signal IGC during the period ΔQa indicates the secondary current instruction value, where the period ΔQa is counted from the first rising timing of the integration signal IGC which indicates the start timing (the ON timing t01 of the ignition signal IGT) of the energy accumulation period ΔT1. This makes it possible to easily detect the secondary current instruction value indicated by the signal level of the integration signal IGC because the integration signal IGC is not influenced by ignition noise around the start timing of the energy accumulation period ΔT1.

Figure 16:
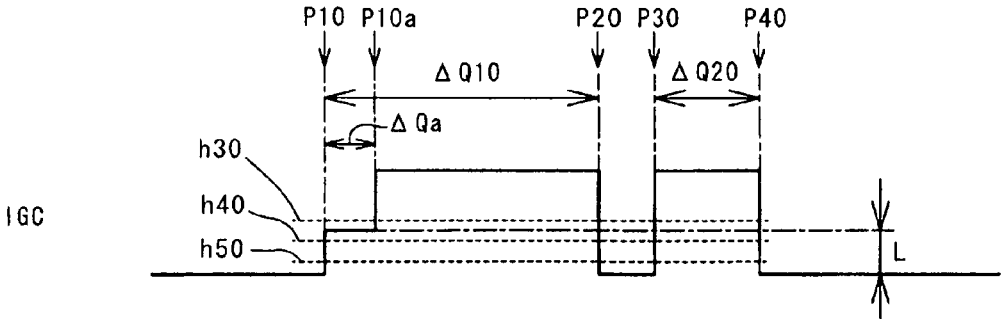
FIG. 16 is a view of explaining a signal pattern of the integration signal used by the ignition device for internal combustion engines according to a fifth exemplary embodiment of the present invention.

In the integration signal IGC shown in FIG. 16, the OFF timing t02 of the ignition signal IGT is detected on the basis of the signal level change point P20 when the integration signal IGC is switched from the high level to the low level. Further, the ON timing t03 of the discharge continuous signal IGW is detected on the basis of the signal level change point P30 when the integration signal IGC is switched from the low level to the high level. However, as shown in FIG. 17, it is possible for the integration signal IGC to have a stair structure in which the signal level of the integration signal IGC is changed stepwise, and to detect the timing t03 and the timing t04 on the basis of the signal level change point of the signal level of the integration signal IGC having the stair structure.

Figure 17:
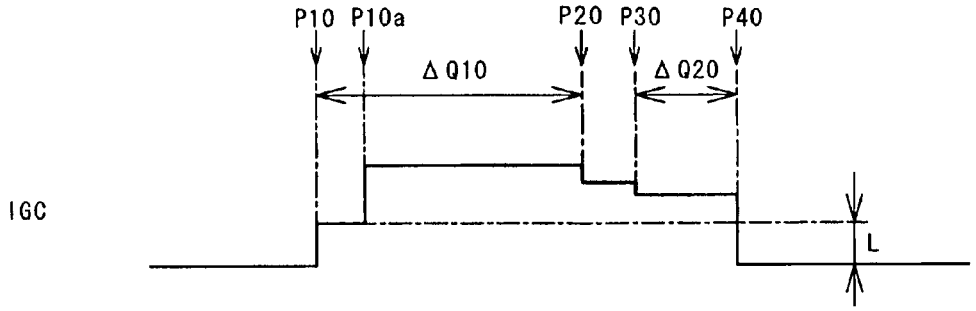
FIG. 17 is a view of explaining a signal pattern of the integration signal used by the ignition device for internal combustion engines according to the fifth exemplary embodiment of the present invention.

That is, in the integration signal IGC shown in FIG. 17, the signal level of the integration signal IGC is slightly reduced at the timing P20, further reduced at the timing P30, and finally becomes the low level at the timing P40. This signal structure makes it possible to contain necessary signal information such as the ignition signal IGT and the discharge continuous signal IGW into the integration signal IGC.

Sixth Exemplary Embodiment

Figure 18:
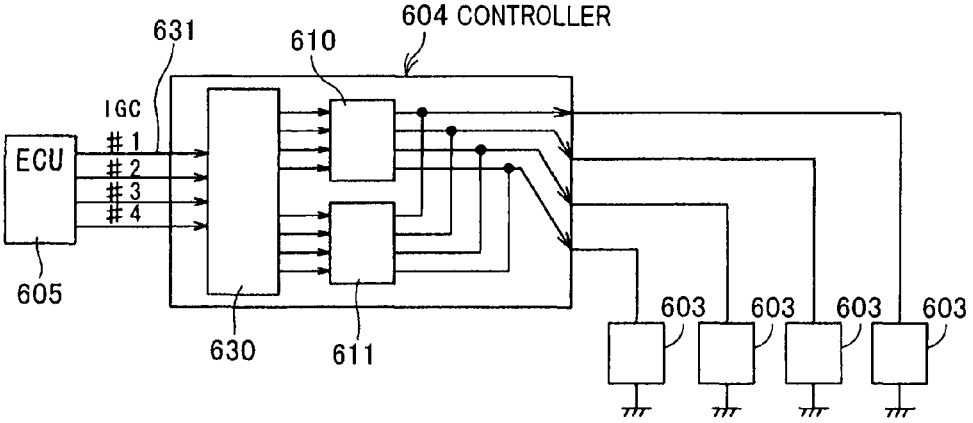
FIG. 18 is a view showing a schematic structure of the ignition device for internal combustion engines according to a sixth exemplary embodiment of the present invention.
Figure 23:
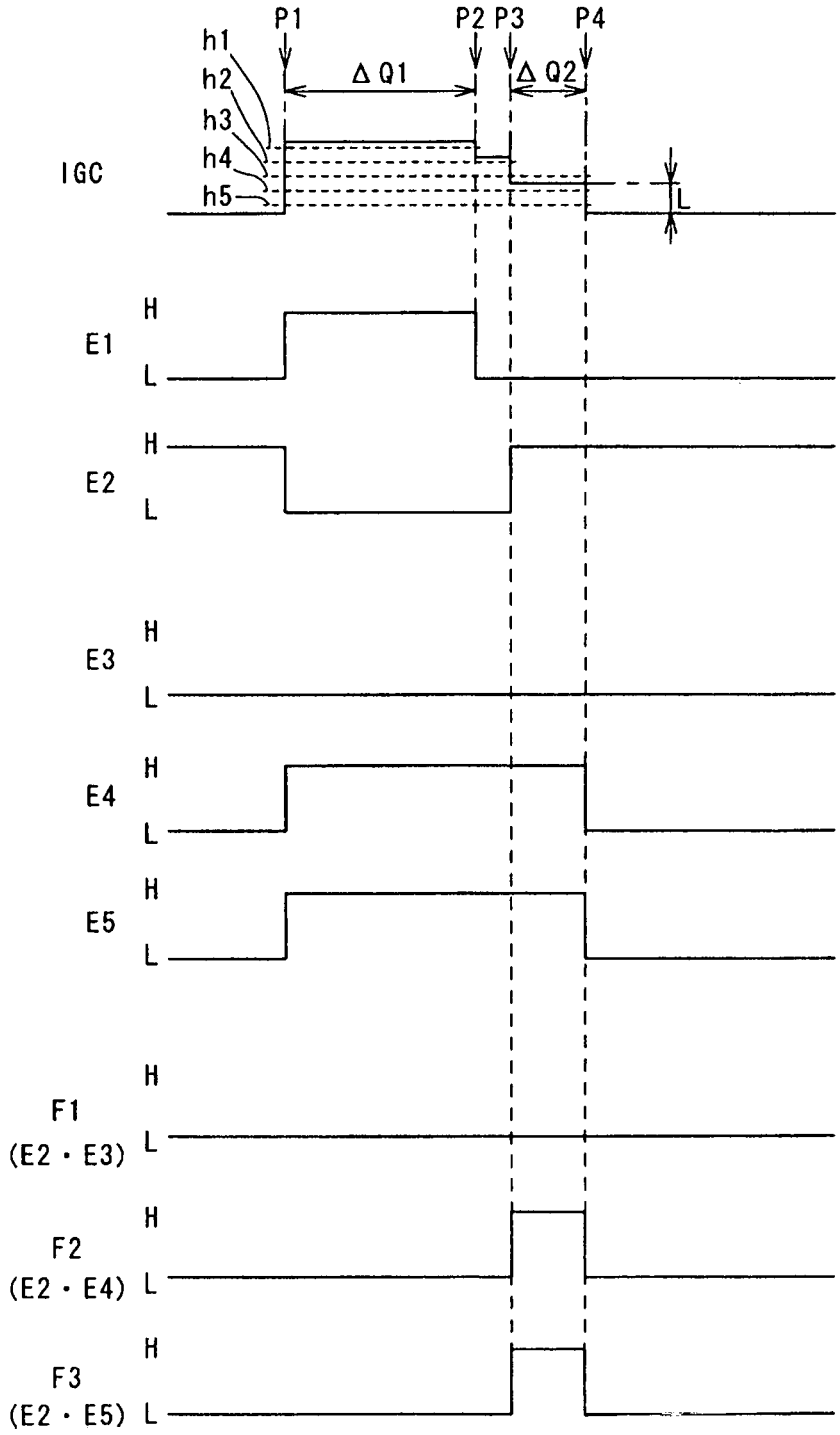
FIG. 23 is a timing chart showing the signal separation by the ignition device according to the sixth exemplary embodiment of the present invention.
Figure 24:
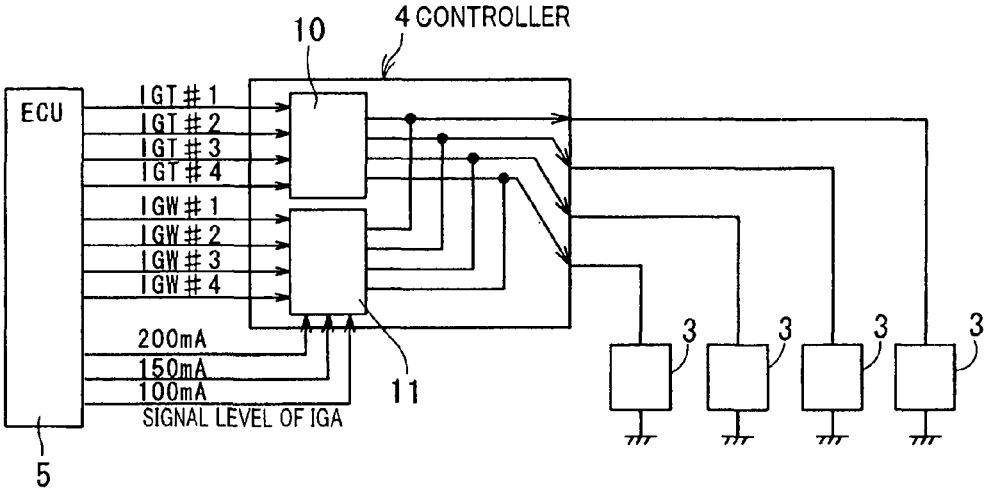
FIG. 24 is a view showing a schematic structure of an ignition device for internal combustion engines according to a comparison example.

A description will be given of the ignition device for internal combustion engines according to the sixth exemplary embodiment with reference to FIG. 18 and FIG. 23. The ignition device for internal combustion engines according to the sixth exemplary embodiment is mounted on a spark plug engine mounted on a vehicle. The ignition device performs ignition of a mixture gas in a combustion chamber of the internal combustion engine at a predetermined ignition timing (ignition period). The internal combustion engine is a gasoline direct injection engine capable of performing a burning of fuel with excess air (lean burn combustion), and the gasoline direct injection engine has a swirling flow control means capable of generating a swirling flow (tumble flow, swirl flow, etc.) in a cylinder of the engine.

The ignition device for internal combustion engines according to the sixth exemplary embodiment is a DI (Direct Ignition) type using an ignition coil 603 which corresponds to an ignition plug 601 of each of the cylinders of the engine.

Figure 19:
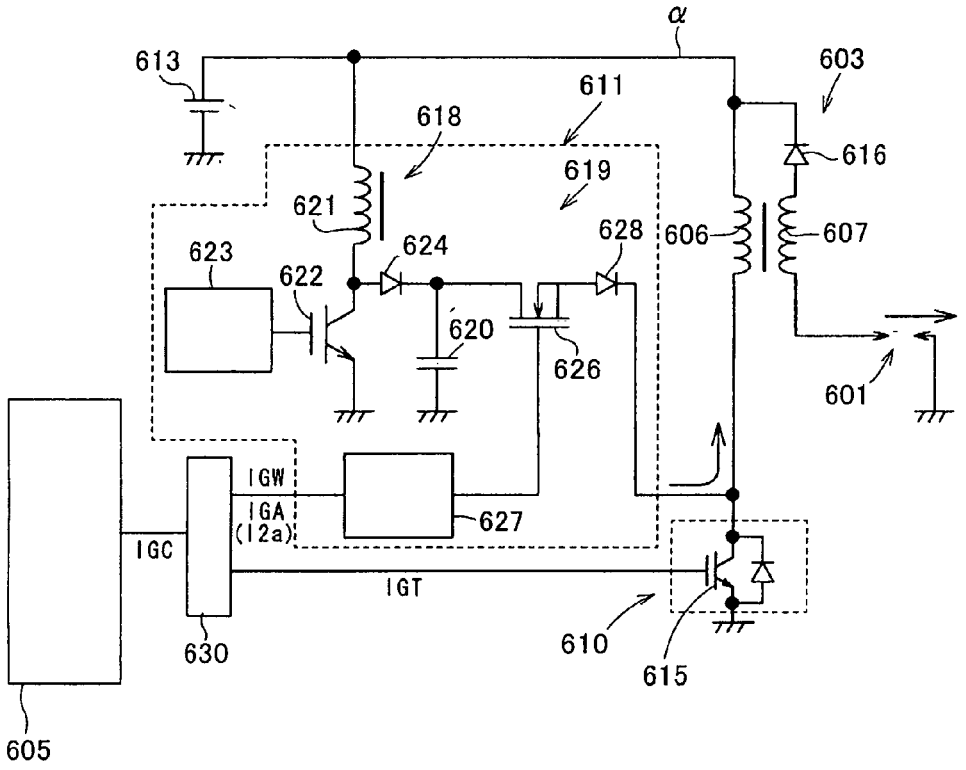
FIG. 19 is a view showing a schematic structure of the ignition device according to the sixth exemplary embodiment of the present invention for controlling a cylinder of the internal combustion engine.

A description will now be given of a schematic structure of the ignition device with reference to FIG. 18 and FIG. 19. FIG. 18 is a view explaining a schematic structure of a circuit of the ignition device for one cylinder. The ignition device is equipped with the ignition plug 601, the ignition coil 603, the controller 604 for controlling the main ignition and the continuous spark discharge, and an ECU 605. The ECU 605 transmits necessary signals to the controller 604.

The controller 604 performs a current control of a primary coil 6 of the ignition coil 603 on the basis of instruction signals (ignition signal IGT, discharge continue signal IGW and a secondary current instruction signal IGA) transmitted from the ECU 605. The controller 604 performs the current control of the primary coil 603 to generate electric energy in a secondary coil 607 and perform a spark discharge of the ignition plug 601. The controller 604 has a main ignition circuit 610, and an energy supply circuit 611 which will be explained later.

The ignition plug 601 is a known device having a central electrode and an external electrode to generate spark discharge between the central electrode and the external electrode by using electric energy generated in the secondary coil 607. The central electrode is connected to one terminal of the secondary coil 607 of the ignition coil 603 through an output terminal. The external electrode is grounded through a cylinder head, etc. of the engine. The ignition plug 601 is arranged to each of the cylinders of the engine.

The ignition coil 603 has the primary coil 606 and the secondary coil 7. The secondary coil 607 is larger in coil turns than the primary coil 606.

One terminal of the primary coil 606 is connected to the positive terminal of the ignition coil 603. The positive terminal of the ignition coil 603 is connected to a battery voltage supply line a (through which electric power is supplied from the positive electrode of an in-vehicle battery 613). The other terminal of the primary coil 606 is connected to an earth terminal of the ignition coil 603. The earth terminal of the ignition coil 603 is grounded through an ignition switching means 615 (a power transistor, a MOS transistor, etc.) of the main ignition circuit 610.

As previously described, one terminal of the secondary coil 607 is connected to the output terminal, and the output terminal is connected to the central electrode of the ignition coil 601. The other terminal of the secondary coil 607 is connected to the battery voltage supply line a or earthed. In a concrete example, the other terminal of the secondary coil 607 is connected to the positive terminal of the ignition coil 603 through a first diode 616. This first diode 616 suppresses unnecessary voltage generated when the electric power is supplied to the primary coil 606.

The main ignition circuit 610 is a circuit capable of supplying electric power to the primary coil 606 of the ignition coil 603 to generate the spark discharge in the ignition plug 601. The main ignition circuit 610 supplies a voltage (battery voltage) of the in-vehicle battery 613 to the primary coil 606 during the ignition signal IGT supply period. Specifically, the main ignition circuit 610 has the ignition switching means 615 (power transistor, etc.) capable of supplying electric power to the primary coil 606 and interrupting the electric power supply to the primary coil 606. When receiving the ignition signal IGT, the main ignition circuit 610 turns on the ignition switching means 615 to supply the battery voltage to the primary coil 606.

Figure 25:
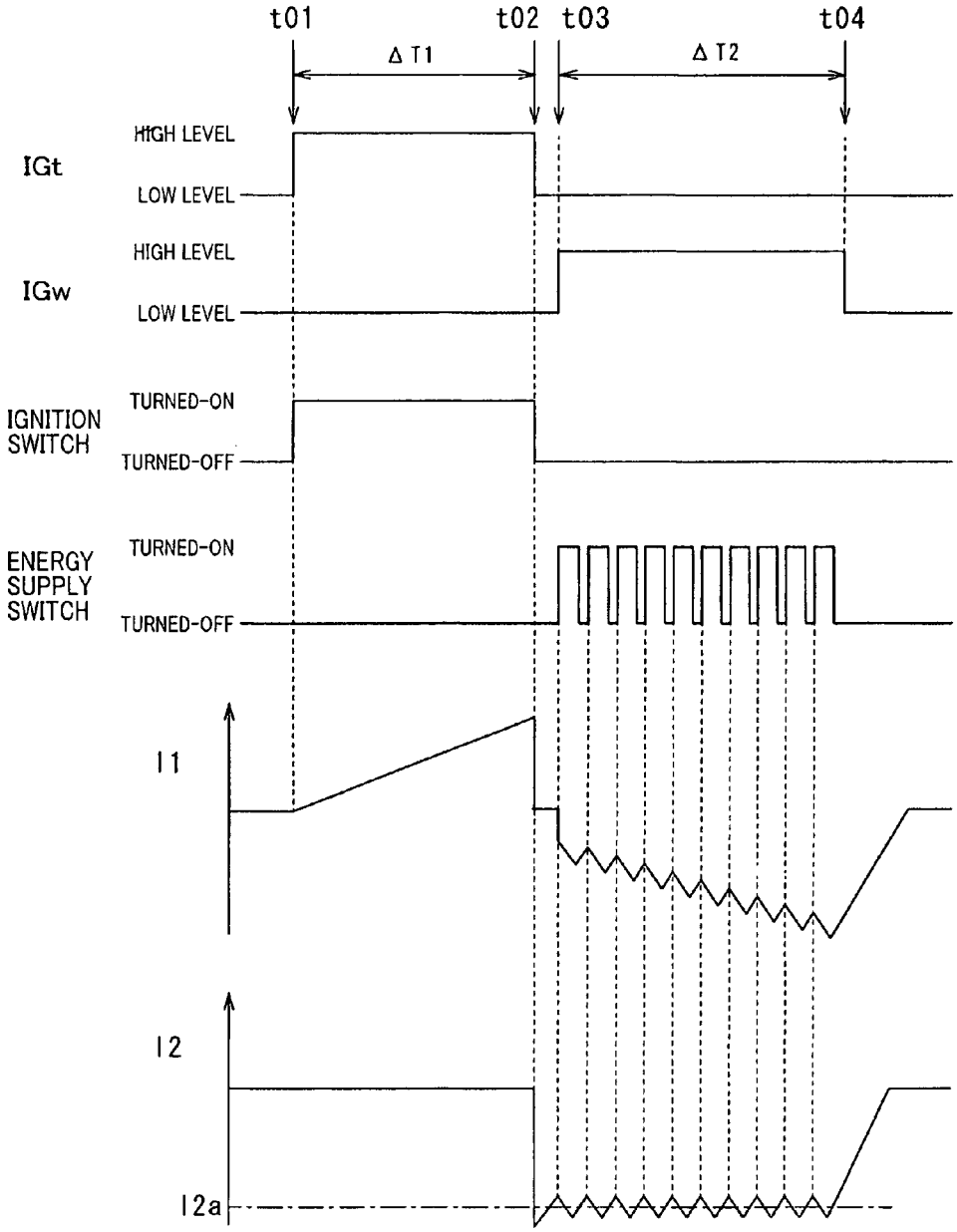
FIG. 25 is a timing chart explaining operation of the ignition device for internal combustion engines according to the comparative example.

The ignition signal IGT is an instruction signal (see FIG. 25) to determine the period (the energy accumulation period ΔT1), in which the main ignition circuit 610 accumulates electromagnetic energy in the primary coil 606, and to provide the discharge start timing t02.

The energy supply circuit 611 supplies electric power to the primary coil 606 during the spark discharge started by the operation of the main ignition circuit 610 in order to supply the secondary current in the secondary coil 607 in the same direction. The operation of the main ignition circuit 610 can continue the spark discharge started by the operation of the main ignition circuit 610.

The energy supply circuit 611 is comprised of a booster circuit 618 and an energy supply control means 619 which will be explained below.

The booster circuit 618 boosts a voltage of the in-vehicle battery 613 to accumulate the electric energy in the capacitor 620 during the period of the ignition signal IGT transmitted from the ECU 605.

The energy supply control means 619 supplies the electric energy accumulated in the capacitor 620 to the negative terminal (the earth side) of the primary coil 606.

The booster circuit 618 is equipped with the capacitor 620, a choke coil 621, a booster switching means 622, a booster driver circuit 623 and a second diode 624. For example, the booster switching means 622 is comprised of an insulated gate bipolar transistor.

One terminal of the choke coil 621 is connected to the positive electrode of the in-vehicle battery 613. The booster switching means 622 turns on and off the choke coil 621. The booster driver circuit 623 transmits a control signal to the booster switching means 622 in order to turn on and off the booster switching means 622. The turning on and off operation of the booster switching means 622 charges the capacitor 620 with the electromagnetic energy accumulated in the choke coil 621. Thereby, the capacitor 620 accumulates the electric energy therein.

The booster driver circuit 623 drives the repetition of turning on and off of the booster switching means 622 every predetermined period in which the ECU 605 transmits the ignition signal IGT. The second diode 624 prevents the supply of the electric energy accumulated in the capacitor 620 to the choke coil 621 side.

The energy supply control means 619 is equipped with an energy supply switching means 626, an energy supply driver circuit 627 and a third diode 628. The energy supply switching means 626 is composed of a MOS transistor, for example. The energy supply switching means 626 turns on and off the supply of the electric energy accumulated in the capacitor 620 to the negative side (low voltage side) of the primary coil 606. The energy supply driver circuit 627 transmits a control signal to the energy supply switching means 626 to turn on and off.

The energy supply driver circuit 627 turns on and off the energy supply switching means 626 to adjust the electric energy of the capacitor 620 to be supplied to the primary coil 606. This control makes it possible to maintain the secondary current to the secondary current instruction value I2*a* during the period when the energy supply driver circuit 627 receives the discharge continuous signal IGW.

The discharge continuous signal IGW is a signal showing the energy supply timing t03 and the period to continue the spark discharge of the ignition plug 603. In more specifically, the discharge continuous signal IGW instructs the energy supply switching means 626 to turn on and off repeatedly during the period (the energy supply period ΔT2) in which the electric energy is supplied from the booster circuit 618 to the primary coil 606. The third diode 628 prevents the supply of the current from the primary coil 606 to the capacitor 620.

In a concrete example of the energy supply driver circuit 627, there is a circuit to perform the turning on and off control of the energy supply switching means 626 by using an open control which maintains the secondary current at the secondary current instruction value I2*a*. There is another circuit to perform a feedback control of the turning on and off state of the energy supply switching means 626 in order to maintain a monitored secondary current at the secondary current instruction value I2*a*.

It is possible to use, as the secondary current instruction value I2*a*, a constant value or a variable value due to the operation state of the engine. The sixth exemplary embodiment uses an instruction signal as the secondary current instruction signal IGA because of selecting a value from three current values which correspond to the operation state of the engine, and transmits the selected value to the energy supply circuit 11.

(Features of the Ignition Device for Internal Combustion Engines According to the Sixth Exemplary Embodiment)

The ECU 605 forms the integration signal transmission section for transmitting the integration signal IGC which contains the ignition signal IGT, the discharge continuous signal IGW and the secondary current instruction signal IGA, which correspond to engine parameters and an engine control state.

The engine parameters represent a warming-up state, an engine rotation speed, an engine load, etc., and the engine control state represents whether a lean burn combustion occurs or does not occur, a state of tumble flow, swirl flow, etc. in a cylinder of the engine.

A signal separation section 630 is arranged in the controller 604, and capable of separating the ignition signal IGT, the discharge continuous signal IGW and the secondary current instruction signal IGA from the integration signal IGC. The signal separation section 630 outputs the ignition signal IGT separated from the integration signal IGC to the main ignition section 610. Further, the signal separation section 630 outputs the discharge continuous signal IGW and the secondary current instruction signal IGA separated from the integration signal IGC to the energy supply section 611.

Figure 20:
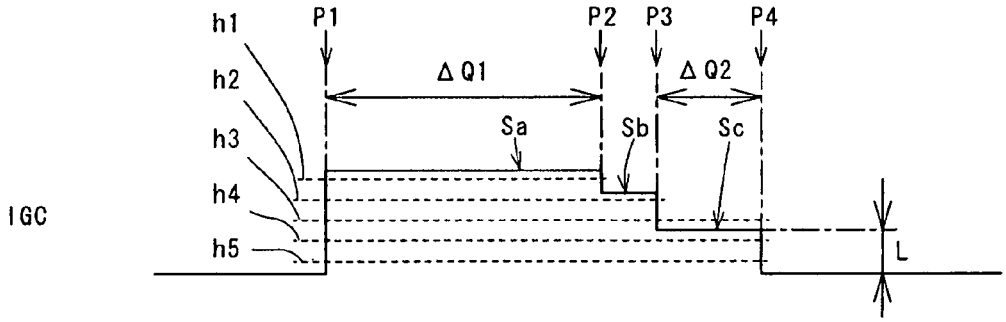
FIG. 20 is a view of explaining a signal pattern of the integration signal used by the ignition device for internal combustion engines according to the sixth exemplary embodiment of the present invention.

A description will be given of the concrete example of the integration signal IGC used by the ignition device according to the sixth exemplary embodiment with reference to FIG. 20. The following explanation regards to the integration signal IGC for the first cylinder of the engine. The integration signal IGC has a stair structure comprising a plurality of signal levels in which three signal levels are time-changed stepwise. That is, the high level of the integration signal IGC is composed of a first high-level signal Sa, a second high-level signal Sb and a third high-level signal Sc which are changed in the time elapsed and will be explained below.

At a predetermined timing P1, the signal separation section 630 outputs the first high-level signal Sa which exceeds a threshold value h1. After the first high-level signal Sa is maintained during a predetermined period ΔQ1, the signal separation section 630 reduces the signal level stepwise at a predetermined timing P2, and outputs the second high-level signal Sb which is not more than the threshold value h1 and exceeds the threshold value h2. After the second high-level signal Sb is maintained during a predetermined period, the signal separation section 630 further reduces the signal level of the integration signal IGC at a predetermined timing P3, and outputs the third high-level signal Sc which is not more than the threshold value h2 and exceeds one of the threshold values h3 to h5. After maintaining the third high-level signal Sc during a predetermined period ΔQ2, the signal separation section 630 outputs the integration signal IGC of a low-level (OFF) at a predetermined timing P4.

In the integration signal IGC having the stair structure, the timing P2 (change point of the signal level) corresponds to the OFF timing (discharge start timing t02) of the ignition signal IGT. In addition, the timing P1 corresponds to the ON timing t01 of the ignition signal IGT. The timing P3 (as the change point of the signal level) corresponds to the ON timing (the energy supply timing t03) of the discharge continuous signal IGW. The predetermined period ΔQ2 corresponds to the turned-on continuous period (the energy supply period ΔT2) of time of the discharge continuous signal IGW. The timing P4 corresponds to the turned-off timing t04 of the discharge continuous signal IGW.

The height L of the third high-level signal Sc corresponds to the secondary current instruction signal IGA. That is, the signal separation section 300 extracts the secondary current instruction signal IGA having the current value selected from the three current value on the basis of the threshold values h3 to h5.

Specifically, the integration signal IGC has a signal level of less than the threshold value h4 and not less than the threshold value h5 when the secondary current instruction value I2*a* is 200 mA. The integration signal IGC has a signal level of less than the threshold value h3 and not less than the threshold value h4 when the secondary current instruction value I2*a* is 150 mA. The integration signal IGC has a signal level of less than the threshold value h2 and not less than the threshold value h3 when the secondary current instruction value I2*a* is 100 mA. That is, when the signal level is less than the threshold value h2 and not less than the threshold value h3, the integration signal IGC shows that the secondary current instruction value I2*a* is 100 mA. When the signal level is less than the threshold value h3 and not less than the threshold value h4, the integration signal IGC shows that the secondary current instruction value I2*a* is 150 mA. Further, when the signal level is less than the threshold value h4 and not less than the threshold value h5, the integration signal IGC shows that the secondary current instruction value I2*a* is 200 mA. Accordingly, the height L of the signal level of the third high-level signal Sc corresponds to the signal showing the secondary current instruction signal IGA.

Figure 21:
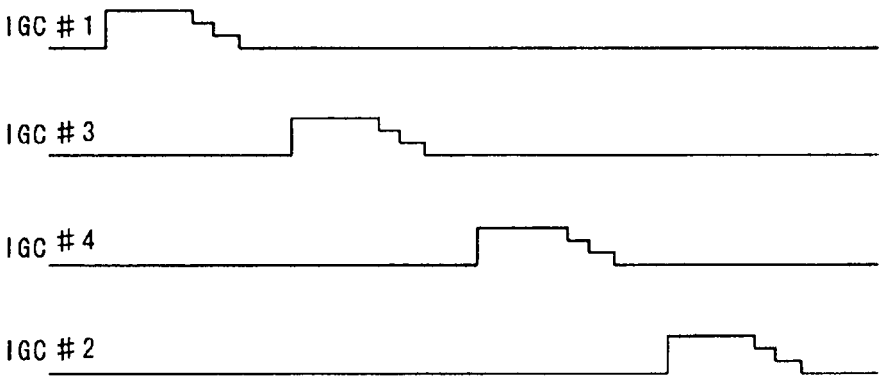
FIG. 21 is a timing chart showing the integration signal used by the ignition device for internal combustion engines according to the sixth exemplary embodiment of the present invention.
Figure 22:
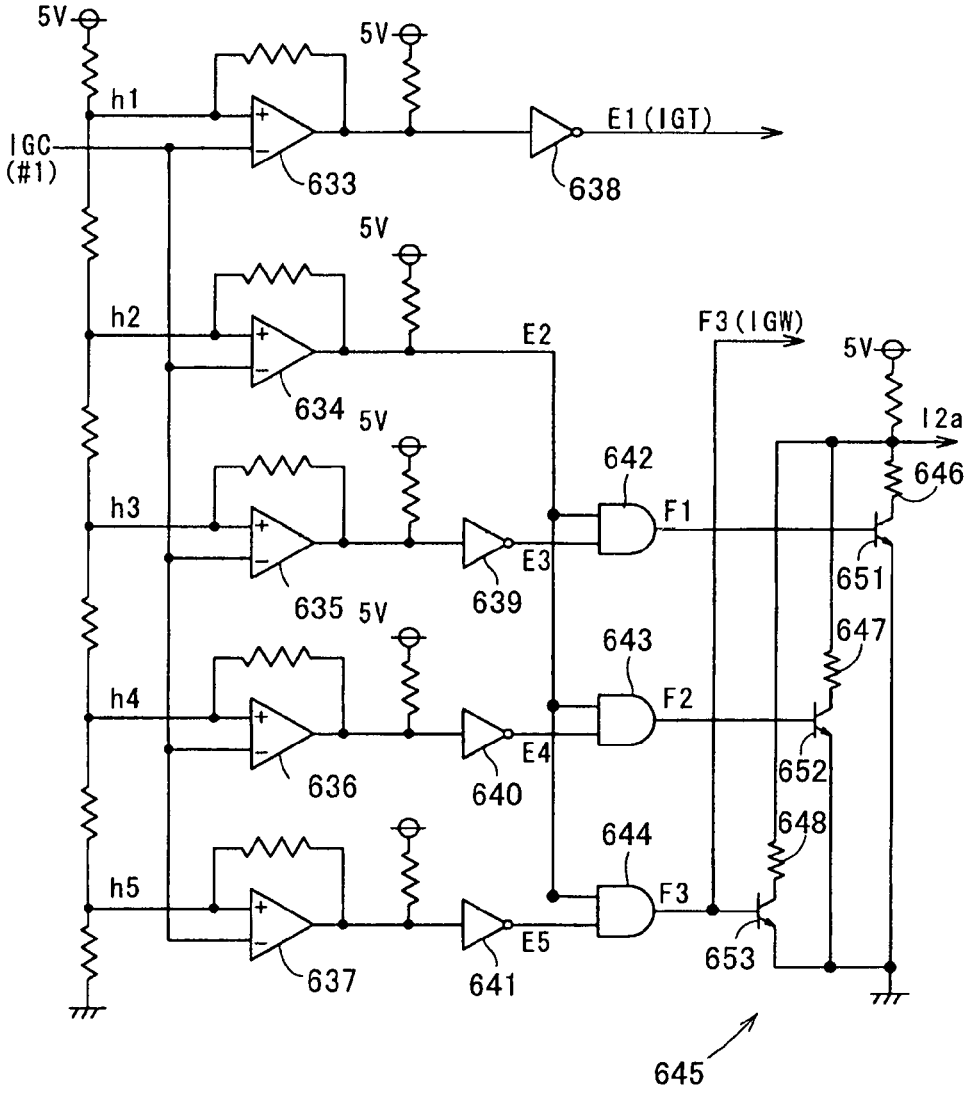
FIG. 22 is a view showing a schematic structure of the signal separation section in the ignition device for internal combustion engines according to the sixth exemplary embodiment of the present invention.

As shown in FIG. 21, the integration signal IGC is generated as the signals IGC#1 to IGC#4 for the corresponding cylinders, respectively, and transmitted to the controller 604. Each of the integration signals IGC#1 to IGC#4 has a different phase which is shifted to each other corresponding to the ignition timing of each cylinder.

Next, a description will be given of the signal separation of the integration signal IGC for the first cylinder performed by the signal separation section 630. The signal separation of the integration signal ICG for the first cylinder will be explained below.

The signal separation section 630 is composed of comparators 633 to 637, NOT circuits 638 to 641, AND circuits 642 to 644, an analogue output circuit 645, etc.

The comparator 633 compares the integration signal IGC with the threshold value h1, and outputs a low level signal when the integration signal IGC is higher than the threshold value h1. The NOT circuit 638 inverts the output of the comparator 633 to extract a signal E1.

The high-level period ΔQ1 of this signal E1 becomes the energy accumulation period ΔT1, and the timing P2 from the high level to the low level corresponds to the discharge start timing t02. That is, the signal E1 can be used as the ignition signal IGT. Accordingly, the ignition signal IGT is extracted from the integration signal IGC and outputs the extracted ignition signal IGT to the main ignition circuit 610.

The comparator 634 compares the integration signal IGC with the threshold value h2, and outputs the signal E2 of a low level signal when the integration signal IGC is higher than the threshold value h2.

The comparator 635 compares the integration signal IGC with the threshold value h3, and outputs a low level signal when the integration signal IGC is higher than the threshold value h3. The NOT circuit 639 inverts the low level signal transmitted from the comparator 635 to generate a signal E3.

The comparator 636 compares the integration signal IGC with the threshold value h4, and outputs a low level signal when the integration signal IGC is higher than the threshold value h4. The NOT circuit 640 inverts the low level signal transmitted from the comparator 636 to generate a signal E40.

The comparator 637 compares the integration signal IGC with the threshold value h5, and outputs a low level signal when the integration signal IGC is higher than the threshold value h5. The NOT circuit 641 inverts the low level signal transmitted from the comparator 637 to generate a signal E5.

The AND circuit 642 performs a logical product of the signal E2 and the signal E3 to generate a signal F1. The signal F1 is at a high level when the secondary current instruction value I2*a* is 100 mA.

The AND circuit 643 performs a logical product of the signal E2 and the signal E4 to generate a signal F2. The generated signal F2 becomes a high level when the secondary current instruction value I2*a* is 100 mA or 150 mA. The AND circuit 644 performs a logical product of the signal E2 and the signal E5 to generate a signal F3. The generated signal F3 becomes a high level when the secondary current instruction value I2*a* is 100 mA, 150 mA or 200 mA.

The predetermined period ΔQ2, in which the signals F2 and F3 have a high level, corresponds to the energy supply period ΔT2. The timing P3, at which is the signals F2 and F3 are switched to the high level from the low level, corresponds to the energy supply timing t03, i.e. corresponds to the discharge continuous signal IGW.

Accordingly, the signal separation section 630 extracts the signal F3, which is at the high level every secondary current instruction value I2*a*, as the discharge continuous signal IGW, and outputs the discharge continuous signal IGW to the energy supply circuit 611.

The analogue output circuit 645 is composed of first to fourth resistances 646 to 648 connected parallel to each other, first to fourth switching elements 651 to 653, etc. The switching elements 651 to 653 are connected in series to the resistors 646 to 648, respectively.

The first switching element 651 is turned ON when the signal F1 is at the high level, and turned OFF when the signal F1 has the low level. The second switching element 652 is turned ON when the signal F2 is at the high level, and turned OFF when the signal F2 has the low level. The third switching element 653 is turned ON when the signal F3 is at the high level, and turned OFF when the signal F3 is at the low level.

Only the third switching element 653 is turned ON when the signal F1 is at the low level, the signal F2 is at the low level and the signal F3 is at the high level, and turned OFF when the signal F3 is at the low level. Further, both the second switching element 652 and the third switching element 653 are turned ON when the signal F1 is at the low level, the signal F2 is at the high level and the signal F3 is at the high level. All of the first switching element 651, the second switching element 652 and the third switching element 653 are turned ON when the signal F1 is at the high level, the second, signal F2 is at the high level and the third signal F3 is at the high level.

Each of the resistances 646 to 648 has a resistance value so as to output a current of 200 mA when only the third switching element 653 is turned ON, so as to output a current of 150 mA when both the second switching element 652 and the third switching element 653 are turned ON, and so as to output a current of 100 mA when all of the first switching element 651, the second switching element 652 and the third switching element 653 are turned ON. Accordingly, the signals F1 to F3 are extracted from the secondary current instruction signal IGA which is an instruction signal to select one of the three current values and output the selected current value to the energy supply circuit 611. Actually, the analogue output circuit 645 outputs the secondary current instruction value I2*a* based on the signals F1 to F3.

(Effects of the Ignition Device for Internal Combustion Engines According to the Sixth Exemplary Embodiment)

In the structure of the ignition device for internal combustion engines according to the sixth exemplary embodiment, the ECU 605 corresponds to the integration signal transmission section capable of outputting the integration signal IGC in which the ignition signal IGT, the discharge continuous signal IGW and the secondary current instruction signal IGA are integrated. In addition, the signal separation section 630 is arranged in the controller 604. The signal separation section 630 extracts the ignition signal IGT, the discharge continuous signal IGW and the secondary current instruction signal IGA from the integration signal IGC. The signal separation section 630 outputs the ignition signal IGT extracted from the integration signal IGC to the main ignition circuit 610 and outputs the discharge continuous signal IGW and the secondary current instruction signal IGA to the energy supply circuit 611.

That is, the ignition device according to the sixth exemplary embodiment uses the integration signal IGC in which the discharge continuous signal IGW and the secondary current instruction signal IGA are added to the ignition signal IGT. Because the signal separation section 630 is arranged in the controller 604, it is possible for the ECU 605 to generate the integration signal IGC and transmit the generated integration signal IGC only through the signal line 31 between the ECU 605 and the controller 604. That is, this structure makes it possible to eliminate the signal lines to be used for transmitting the ignition signal IGT and the discharge continuous signal IGW to each of the cylinders of the engine. Furthermore, this structure makes it possible to eliminate the signal line to transmit the secondary current instruction signal IGA. This structure makes it possible to reduce the total number of the signal lines arranged between the ECU 605 and the controller 604.

INDUSTRIAL APPLICABILITY

The ignition device for internal combustion engines according to the first to third, exemplary embodiments uses the multiplex signal IGWc in which the secondary current instruction signal IGA is added, where the secondary current instruction signal IGA shows the secondary current instruction value I2*a*. It is also acceptable to use the multiplex signal IGWc without adding the secondary current instruction signal IGA.

The ignition device for internal combustion engines according to the first to third exemplary embodiments uses the multiplex signal in which the signals for all of the cylinders of the engine are multiplexed. However, it is acceptable to use a multiplex signal to be used for at least two cylinders of the engine. In this case, it is preferable to select a combination of the cylinders so that the ignition timings thereof become separated by long periods of time.

The ignition device for internal combustion engines according to the fourth to sixth exemplary embodiments uses the integration signal IGC into which the secondary current instruction signal IGA is added, where the secondary current instruction signal IGA shows the secondary current instruction value I2*a*. However, it is possible to use the integration signal IGC without adding the secondary current instruction signal IGA.

The first to sixth exemplary embodiments have shown the cases in which the ignition device according to the present invention is applied to a gasoline engine. Because the ignitability of fuel (specifically, a mixture of fuel and air) can be improved by using the continuous spark discharge, it is possible to apply the ignition device according to the present invention to engines using ethanol fuel and engines using mixture gas. It is also possible to improve the ignitability of fuel even if the ignition device according to the present invention is applied to engines using inferior fuel.

The first to sixth exemplary embodiments have shown the cases in which the ignition device according to the present invention is applied to the engine capable of performing a burning of fuel with excess air (lean burn combustion). However, it is possible to apply the ignition device according to the present invention to various engines which cannot perform the lean burn combustion because the ignitability of fuel (specifically, a mixture of fuel and air) can be improved by using the ignition device performing the continuous spark discharge.

The first to sixth exemplary embodiments have shown the cases in which the ignition device according to the present invention is applied to direct injection engines. However, it is possible to apply the ignition device according to the present invention to port injection engines in which fuel is injected into the upper side of the intake valve (inside of the intake port).

The first to sixth exemplary embodiments have shown the cases in which the ignition device according to the present invention is applied to the engine capable of forcedly generating a swirling flow (tumble flow, swirl flow, etc.) in the cylinders of the engine. It is also possible to apply the concept of the present invention to engines without having the swing flow control means (such as a tumble flow control valve, a swirl flow control valve, etc.).

The first to sixth exemplary embodiments have shown the cases in which the ignition device according to the present invention is applied to a DI type ignition devices. However, it is possible to apply the concept of the present invention to single cylinder engines (for example, motorcycles, etc.) which do not require a secondary voltage distribution.

REFERENCE SIGNS LIST

1, 601 Ignition plug,
3, 603 Ignition coil,
5, 605 ECU (Multiplex signal transmission section, integration signal transmission section),
6, 606 Primary coil,
7, 607 Secondary coil,
10, 610 Main ignition circuit,
11, 611 EWnergy supply circuit,
30 Cylinder signal extraction section, and
300, 630 Signal separation section.

What is claimed is:

1. An ignition device for internal combustion engines comprising:

a main ignition circuit performing power supply control of a primary coil in an ignition coil to generate spark discharge in a corresponding ignition plug, the ignition coil being arranged in a cylinder of a multi-cylinder internal combustion engine;

an energy supply circuit supplying electric energy to the primary coil during the spark discharge started by the operation of main ignition circuit in order to supply a secondary current to a secondary coil of the ignition coil, and to maintain continuously the spark discharge initiated by the operation of the main ignition circuit;

a multiplex signal transmission section generating a multiplex signal in which at least two cylinder discharge continuous signals have been multiplexed, and transmitting the generated multiplex signal; and a cylinder signal extraction section receiving the multiplex signal and extracting the cylinder discharge continuous signals from the received multiplex signal, wherein the ignition device performs the spark discharge of the ignition plug continuously on the basis of the cylinder discharge continuous signals.

2. The ignition device for internal combustion engines according to claim 1, wherein the multiplex signal transmission section adds a secondary current instruction signal representing a secondary current instruction value into the multiplex signal, and transmits the multiplex signal, and the energy supply circuit maintains the secondary current supplying in the secondary coil of the ignition coil within a target current range on the basis of the secondary current instruction value indicated by the secondary current instruction signal.

3. The ignition device for internal combustion engines according to claim 1, wherein the multiplex signal transmission section generates the multiplex signal in which all of the cylinder discharge continuous signals have been multiplexed.

4. An ignition device for internal combustion engines comprising:

a main ignition circuit performing power supply control of a primary coil in an ignition coil to generate spark discharge in a corresponding spark plug;

an energy supply circuit supplying electric energy to the primary coil during the spark discharge started by the operation of main ignition circuit in order to supply a secondary current in a secondary coil of the ignition coil, and to maintain continuously the spark discharge initiated by the operation of the main ignition circuit;

an integral signal transmission section generating an integration signal for each cylinder in which a discharge continuous signal as an instruction signal of performing continuous spark discharge has been added to an ignition signal as an instruction signal for main ignition operation of the spark plug, and transmitting the generated integration signal for each cylinder through a signal line; and a signal separation section receiving the integration signal (IGC) through the signal line, and separating the ignition signal and the discharge continuous signal from the received integration signal, outputting the ignition signal to the main ignition circuit, and the discharge continuous signal to the energy supply circuit.

5. The ignition device for internal combustion engines according to claim 4, wherein the integral signal transmission section generates and outputs the integration signal in which the discharge continuous signal and the secondary current instruction signal representing a secondary current instruction value have been added to the ignition signal, the signal separation section receives the integration signal, separates the secondary current instruction signal from the received integration signal, and outputs the secondary current instruction signal, and the energy supply circuit maintains the secondary current within a target range on the basis of the secondary current instruction value indicated by the received secondary current instruction signal.

6. The ignition device for internal combustion engines according to claim 4, wherein the integral signal transmission section generates the ignition signal having a stair structure of a signal level thereof so as to add the discharge continuous signal into the ignition signal.

7. The ignition device for internal combustion engines according to claim 5, wherein integral signal transmission section generates the ignition signal having a stair structure of the signal level thereof so as to add the discharge continuous signal and the secondary current instruction signal into the ignition signal.

8. The ignition device for internal combustion engines according to claim 5, wherein the ignition signal instructs an energy accumulation period during which electromagnetic energy is accumulated in the primary coil by the main ignition circuit, and the energy accumulation period is started at a rising timing of the integration signal, and the secondary current instruction value is determined on the basis of a signal level of the integration signal in a predetermined period which is started at a rising timing of the integration signal.

9. An ignition device for internal combustion engines comprising:

a main ignition circuit performing power supply control of a primary coil in an ignition coil to generate spark discharge in a corresponding spark plug;

an energy supply circuit supplying electric energy to the primary coil during the spark discharge started by the operation of main ignition circuit in order to supply a secondary current in a secondary coil of the ignition coil, and to maintain continuously the spark discharge initiated by the operation of the main ignition circuit;

an integral signal transmission section generating an integration signal for each cylinder in which a discharge continuous signal as an instruction signal of performing continuous spark discharge has been added to an ignition signal as an instruction signal for main ignition operation of the spark plug, and transmitting the generated integration signal for each cylinder through a signal line; and a signal separation section receiving the integration signal through the signal line, and separating the ignition signal and the discharge continuous signal from the received integration signal, outputting the ignition signal to the main ignition circuit, and the discharge continuous signal to the energy supply circuit.

10. The ignition device for internal combustion engines according to claim 9, wherein the integral signal transmission section transmits the integration signal in which a secondary current instruction signal representing a secondary current instruction value and the discharge continuous signal have been added to the ignition signal, and the energy supply circuit maintains a secondary current within a target range on the basis of the secondary current instruction value.

11. The ignition device for internal combustion engines according to claim 9, wherein the integral signal transmission section generates the ignition signal having a stair structure of the signal level thereof so as to add the discharge continuous signal into the ignition signal.

12. The ignition device for internal combustion engines according to claim 10, wherein the integral signal transmission section generates the ignition signal having a stair structure of the signal level thereof so as to add the discharge continuous signal and the secondary current instruction signal into the ignition signal.

* * * * *